US009221067B2

(12) United States Patent
Jackson et al.

(10) Patent No.: US 9,221,067 B2
(45) Date of Patent: Dec. 29, 2015

(54) $CO_2$ COMPOSITE SPRAY METHOD AND APPARATUS

(71) Applicants: David Jackson, Saugus, CA (US); Liviu Marian, Los Angeles, CA (US); Felipe Soto, Valencia, CA (US); John Lee, Glendale, CA (US)

(72) Inventors: David Jackson, Saugus, CA (US); Liviu Marian, Los Angeles, CA (US); Felipe Soto, Valencia, CA (US); John Lee, Glendale, CA (US)

(73) Assignee: CLEANLOGIC LLC, Santa Clarita, CA (US)

( * ) Notice: Subject to any disclaimer, the term of this patent is extended or adjusted under 35 U.S.C. 154(b) by 0 days.

(21) Appl. No.: 14/307,488

(22) Filed: Jun. 17, 2014

(65) Prior Publication Data

US 2014/0367479 A1 Dec. 18, 2014

Related U.S. Application Data

(60) Provisional application No. 61/836,635, filed on Jun. 18, 2013, provisional application No. 61/836,636, filed on Jun. 18, 2013.

(51) Int. Cl.

| | |
|---|---|
| ***B05B 7/12*** | (2006.01) |
| ***B05B 12/08*** | (2006.01) |
| ***B05B 7/14*** | (2006.01) |
| ***B08B 7/00*** | (2006.01) |
| ***B24C 1/00*** | (2006.01) |
| ***B24C 7/00*** | (2006.01) |
| ***B65D 83/42*** | (2006.01) |
| ***B65D 83/14*** | (2006.01) |

(52) U.S. Cl.

CPC ..... *B05B 12/082* (2013.01); *B05B 7/1486* (2013.01); *B08B 7/00* (2013.01); *B24C 1/003* (2013.01); *B24C 7/0046* (2013.01); *B65D 83/42* (2013.01); *B65D 83/752* (2013.01)

(58) Field of Classification Search

CPC B05B 7/1626; B05B 7/0884; B05B 7/04833; B24C 7/0046; B24C 1/003; B24C 5/04; B65D 83/752; B65D 83/42; B08B 7/00

USPC ..... 239/398, 337, 411, 8, 10, 11

See application file for complete search history.

(56) References Cited

U.S. PATENT DOCUMENTS

| | | | | |
|---|---|---|---|---|
| 3,884,663 | A | † | 5/1975 | Funaro |
| 5,315,793 | A | | 5/1994 | Peterson |
| 5,725,154 | A | | 3/1998 | Jackson |
| 5,853,128 | A | † | 12/1998 | Bowen |
| 7,134,946 | B1 | † | 11/2006 | Jackson |
| 7,293,570 | B2 | † | 11/2007 | Jackson |
| 7,389,941 | B2 | † | 6/2008 | Jackson |
| 2003/0207655 | A1 | | 11/2003 | Jackson |
| 2009/0136086 | A1 | | 5/2009 | Farina |
| 2011/0233456 | A1 | † | 9/2011 | Jackson |

† cited by third party

*Primary Examiner* — David Hwu

(74) *Attorney, Agent, or Firm* — Law Office of David Hong

(57) ABSTRACT

A method and apparatus is disclosed for the production, delivery and control of microscopic quantities of minute solid carbon dioxide ($CO_2$) particles having uniform density and distribution for use in a $CO_2$ Composite Spray process, which employs compression of liquid carbon dioxide to form a supersaturated liquid, which is then condensed via micro-capillaries into minute and highly energetic solid carbon dioxide particles, which are injected into a propellant gas stream.

30 Claims, 13 Drawing Sheets

Capillary Fluid Density vs. Pressure/Temperature 525
500
506
Front
496
518
522
520
508
V2
516
506
514
504
V1
526
510
Side
498
524
525
502
512
500
496
501
Fig. 4B-II
Large V1
532
506
530
500
534
528
506
Fig. 4B-I
Small V1
500

PRESENT INVENTION

PRESENT INVENTION

PRESENT INVENTION

$CO_2$ COMPOSITE SPRAY METHOD AND APPARATUS

PRIORITY CLAIM

This application claims the benefit of U.S. Provisional Patent Application 61/836,635 (filed 18 Jun. 2013) and 61/836,636 (filed 18 Jun. 2013), which are all incorporated by reference.

BACKGROUND

Field of Invention

The present invention relates to a method and apparatus for producing, controlling and projecting a dense fluid spray, and specifically to carbon dioxide ($CO_2$) solid-gas composite sprays such as the $CO_2$ Composite Spray™, a Trademark of CleanLogix LLC, used for precision cleaning, cooling and machining applications. More particularly, the present invention is an improved $CO_2$ Composite Spray cleaning method and apparatus.

Cleaning delicate surfaces with a strong spray stream consisting of sub-micron sized solid carbon dioxide particles propelled by gaseous carbon dioxide was first proposed by S. A. Hoenig (see "The application of dry ice to the removal of particulates from optical apparatus, spacecraft, semiconductor wafers and equipment used in contaminant free manufacturing processes", September 1985). The theory describing solid/gas carbon dioxide spray causes it to fall under the category of surface preparation and cleaning techniques in the form of a spray stream. The energy available in any spray stream can best be described by the sum of the kinetic energy of each solid component in the stream as defined in the following equation:

$$KE=\tfrac{1}{2}MV^2$$

where: KE=kinetic energy available in the stream; M=mass per unit solid in the stream; and V=velocity of the solid in the stream.

The advantage solid/gas carbon dioxide spray has over gaseous sprays is that the mass term of the equation is increased significantly with the introduction of the solid carbon dioxide particles which in turn increases the kinetic energy available in the stream. The solid/gas carbon dioxide spray stream, with a nozzle exit velocity much lower than a gaseous spray stream, will remove contaminants the gaseous spray stream will not. In fact, the solid/gas carbon dioxide spray stream will remove contaminants that the gaseous spray stream is unable to remove at any nozzle exit velocity.

Following the initial efforts by S. A. Hoenig, referenced above, various efforts were directed to developing methods and apparatus capable of creating a spray stream of a mixture of frozen particles and a delivery gas, as well as the spray stream of solid/gas carbon dioxide. Most were merely capable of producing carbon dioxide solids in a carbon dioxide gaseous spray with no particular effort having been made to optimize the cleaning capability of the system. Only a slight improvement in cleaning over purely gaseous sprays was achieved by the earliest systems. Also, the carbon dioxide available at the time was not very pure or, if it was, it was very expensive. The impure carbon dioxide could not get pristine surfaces clean without leaving behind an undesirable residue, and the pure but expensive carbon dioxide was cost prohibitive, necessitating the development of dense fluid purification and delivery systems.

In the late 1980's researchers at Hughes Aircraft Company began working to investigate and develop new cleaning techniques for optical surfaces. These researchers knew from prior experience that critical optical surfaces, such as vapor deposited gold coatings and pristine polished silicon, will adversely change when any physical contact occurs. The researchers at Hughes were able to improve upon the solid/gas carbon dioxide spray cleaning technology by designing equipment that was much better than the early designs; however, the Hughes Aircraft equipment was extremely expensive.

In the late 1980's and early 1990's other companies, encouraged after seeing the results achieved by Hughes and a few other entities, began developing and marketing solid/gas carbon dioxide spray cleaning equipment. These prior efforts are exemplified by U.S. Pat. No. 4,806,171 issued Feb. 21, 1989 to W. H. Whitlock et al; U.S. Pat. No. 4,962,891, issued Oct. 16, 1990 to L. M. Layden; U.S. Pat. No. 5,125,979, issued Jun. 30, 1992 to E. A. Swain et al; U.S. Pat. No. 5,315,793 issued May 31, 1994 to R. V. Peterson; U.S. Pat. No. 5,354,384, issued Oct. 11, 1994 to J. D. Sneed et al; U.S. Pat. No. 5,364,474, issued Nov. 15, 1994 to J. F. Williford, Jr.; U.S. Pat. No. 5,390,450, issued Feb. 21, 1995 to L. N. Goenka; U.S. Pat. No. 5,409,418, issued Apr. 25, 1995 to K. Krone-Schmidt et al; and U.S. Pat. No. 5,558,110 issued Sep. 24, 1998 to J. F. Williford, Jr.

Conventional cryogenic spray cleaning processes thus described have traditionally employed supersonic de Laval-type (convergent-divergent) spray nozzles. The main disadvantage of de Laval cryogenic spray nozzles is that there is an unbalancing effect at the nozzle exit of the fluid stream. The surrounding fluid (ambient atmosphere) tends to drag the nozzle fluid stream, causing the flow stream to diverge rapidly upon discharge from the nozzle exit. This causes the liquid droplets or sublimable solid particles to expand quickly, resulting in a significant loss of cleaning agent (solid particles) through plume expansion or the production of numerous and small solid particles, which generally requires the spray nozzle to be placed in close proximity to a substrate surface to be effective. The de Laval $CO_2$ spray nozzles produce a two-phase aerosol ($CO_2(g)$-$CO_2(l)$) through a rapid Joule-Thomson expansion process which wastes liquid carbon dioxide and spray cleaning energy is chiefly controlled only by changing the distance between the nozzle exit and the surface, or the liquid $CO_2$ feed pressure (see Bowen '128 described herein). However this is counterproductive because the carbon dioxide aerosol particles are shrinking in size, quantity and velocity, all of which adversely affects spray cleaning control and efficiency. Another shortcoming common to conventional cryogenic spray techniques utilizing de Laval spray nozzle designs is the intrusion and entrainment of atmospheric contaminants into the cryogenic particle flow stream. The most important aspect of these is atmospheric moisture condensation in the spray plume. Wet atmosphere entrained within the cold spray plume boundary is delivered to the surface along with the cleaning spray particles which complicates the cleaning process. Wetness is caused by the lack of effective shielding of the sublimating particle stream from the ambient atmosphere and insufficient heat capacity within the spray boundary to prevent condensation.

To overcome these constraints, improved $CO_2$ spray cleaning and cooling techniques were developed in the late 1990's and early 2000's by the first named inventor comprising unique carbon dioxide ($CO_2$) "composite" sprays ($CO_2$ Composite Spray™, a Trademark of CleanLogix LLC) used in cleaning, cooling and lubrication applications. A $CO_2$ Composite Spray is used today in a number of industrial applications ranging from the removal of submicron particles from hard disk drive component during an assembly operation to the removal of heat from cutting tools and substrates during a precision machining operation.

Examples of more recent conventional apparatuses and methods developed by the first named inventor of the present invention for generating and using a $CO_2$ Composite Spray are described in U.S. Pat. Nos. 5,725,154, 7,293,570, and 7,451,941. These include coaxial $CO_2$ spray cleaning apparatus ('154), sequentially segmented flexible capillary condenser assembly ('570), and flexible enhanced Joule-Thomson capillary in a coaxial spray delivery apparatus and method ('941).

$CO_2$ Composite Sprays employ Coaxial or Coaxial-Coanda two-phase composite spray nozzle designs with so-called "capillary condensation" processes to convert saturated liquid $CO_2$ into solid $CO_2$ particles. A $CO_2$ Composite Spray uses a compressed fluid to accelerate controlled amounts of solid $CO_2$ particles (cleaning or cooling agent) of controllable size, density, concentration, heat capacity and kinetic energy. Compressed gases, also termed dense fluids, are gases compressed above standard temperature and pressure conditions, and may even be compressed to liquid-like densities as well. Examples of dense fluids include compressed air, nitrogen, hydrogen, oxygen, ozone, and carbon dioxide. Compressed gases exhibit a range of solubility chemistry—behaving as both solvents and solutes—depending upon pressure and temperature, and depending upon the cohesion chemistry of the solvent-solute system (reference: *Handbook of Solubility Parameters and other Cohesion Parameters*, A. F. Barton, CRC Press, 1983). Dense fluids are uniquely employed in a $CO_2$ Composite Spray as propellant, cleaning, and cooling fluids. For example, a basic $CO_2$ Composite Spray system compresses $CO_2$ into a saturated liquid $CO_2$. Liquid $CO_2$ is then condensed into microscopic solid $CO_2$ particles. Solid $CO_2$ particles are sized and injected into a temperature- and pressure-regulated dense fluid or compressed gas such as clean-dry-air, $N_2$, Ar, or $CO_2$ and directed at a substrate using various applicator and spray nozzle configurations. The primary function of a propellant gas—also described herein as a "Dense Fluid Propellant Gas"—is to catapult microscopic solid $CO_2$ particles into a surface with sufficient energy to produce a highly dense liquid $CO_2$ at the contacting interface—forming a liquid (or so-called dense fluid) "splat". The combination of energetic solid particle impacts and dense fluid splats provide significant acoustic cavitation, shear stress, and fluorocarbon-like chemistry—and depending upon dense fluid propellant gas temperature and pressure, and $CO_2$ particle concentration and additives—provides infinitely-adjustable cleaning and cooling spray compositions.

To make solid carbon dioxide particles, a capillary condenser assembly comprising an elongated segment (or sequential segments) of thermally-insulating polyetheretherketone (PEEK) capillary tubing is used. A capillary condenser assembly provides a simple and efficient means for subcooling (boiling) and condensing liquid carbon dioxide into a low velocity but dense mass of solid-phase particles. Varying the length and internal diameter(s) of the capillary condenser, including stepping, produces particles having different particle size distribution ranges and density. Once formed, $CO_2$ particles are injected and vortically mixed into a heated dense fluid propellant gas such as nitrogen, clean-dry air, or $CO_2$ gas, any of which may be optionally ionized, which flows coaxially with the capillary condenser assembly. Thus the gaseous propellant pressure and temperature and particle generation are independently and variably controlled to produce a specific type of spray composition and energy for a particular cleaning application. A coaxial or coaxial-Coanda spray nozzle is used to integrate the two streams. In accordance with Bernoulli and/or Coanda flow stream principles the solid $CO_2$ particles are accelerated variably in a range from subsonic to near-sonic velocities.

It is known by those skilled in the art that very small amounts of $CO_2$ particles will perform a lot of cleaning or cooling work. This is a "less is more" process and chemistry paradigm. However, much of the $CO_2$ used within a conventional $CO_2$ cleaning spray is excessive and lean sprays produced by same tend to be spongy (gas-filled). It is understood that a leaner (less particle dense and uniform spray) using more densely compacted particles will produce cleaner surfaces (or cooler surfaces) faster. In this regard, there has been much work to minimize $CO_2$ usage, to improve spray particle uniformity, and to maximize spray work. However, up to this point achieving this goal has been illusive with numerous and varied constraints. First the production of very small amounts $CO_2$ particles must be consistent and efficient. Second small amounts of dimensionally small $CO_2$ particles must be delivered under high velocity propellant mass flow to the surface under energetic conditions needed for efficient cleaning (or cooling) action. Heretofore it has not been possible to achieve high cleaning (or cooling) effectiveness while efficiently generating ultra-small quantities of uniformly distributed $CO_2$ particles within a $CO_2$ Composite Spray as well as more conventional de Laval spray schemes. For example, in the late 1990's, Bowen introduced a high pressure $CO_2$ snow spray apparatus, described under U.S. Pat. No. 5,853,128. In U.S. Pat. No. '128, liquid carbon dioxide is first compressed to between 2,000 psi and 5,000 psi and forced through a de Laval expansion nozzle to improve liquid-to-solid conversion and to increase particle velocity for improved cleaning performance. The principal drawback of this approach is a significant amount of $CO_2$ is used, between 15 and 50 pounds of $CO_2$ per hour per nozzle or more, to increase spray cleaning effectiveness. Another significant drawback is that the rapid condensation through a nozzle expansion means produces a very cold and dense spray that lacks particle size and spray density uniformity. Adjunct means such as hot gas shrouds or jets, environmental processing chambers, and even mechanical spray screens (i.e., U.S. Pat. No. 8,454,409, Bowers et al) must be employed to produce a uniformly distributed $CO_2$ gas-particle spray. Although fluid pressure may be attenuated through the expansion nozzle, upwards or downwards, with the conventional nozzle expansion means, for example the aforementioned '128 invention, to control the mass flow of the resulting treatment stream, the particle size distribution, fluid temperature and spray power of the resulting treatment stream are not independently adjustable and utilize significant amounts of liquid $CO_2$ to produce a suitable mass of treatment particles.

Moreover, newer composite spray methods and apparatuses by the first name inventor of the present invention described in U.S. Pat. Nos. '154, '570 and '941 herein have not heretofore been successful in achieving precise $CO_2$ particle generation and flow control at very low flow rates. For example micrometering saturated liquid $CO_2$ into and through a capillary condenser below 3 to 5 pounds $CO_2$ per hour produces significant sputtering (or choking) and/or particle loss (sublimation) during transport to the coaxial mixing and acceleration nozzle. Compounding this problem, conventional $CO_2$ Composite Sprays employ a liquid $CO_2$ supply scheme that controls liquid $CO_2$ supply pressure, temperature and density within a very broad pressure and temperature range along the saturation line.

For example, conventional capillary condensers having internal diameters (ID) of 0.020, 0.030 and 0.080 inches, or sequential segments comprising all three diameters, cannot be effectively metered using saturated liquid $CO_2$ injection and an 18-turn micrometering valve. An 18-turn metering valve used to control saturated liquid $CO_2$ capillary injection in the range between 0.1 to 2 turns, representing a flow orifice adjustment range of between approximately 0.001 and 0.004 inches, results in clogging, sputtering, choking and sinusoidal-like spray fluctuations due to the saturated liquid $CO_2$ boiling (cooling, pressure dropping and expansion) within the metering valve body and internal capillary segments. This problem is greatly worsened using shorter segments of these capillaries, for example using a 0.030 ID capillary with a capillary condenser loop segment shorter than 36 inches in length. Using smaller capillary ID' s such as 0.020 inch or smaller and stepped configurations starting with same such as described under U.S. Pat. No. '570 in combination with metered saturated liquid carbon dioxide introduces more capillary pressure through restriction which improve flowability but significantly diminishes the amount of $CO_2$ particle generation (particle spray density) and mass flow control. For these reasons capillaries smaller than 0.020 inch, and in particular small capillaries have lengths longer than a couple of feet, have not been preferred in commercial $CO_2$ Composite Spray cleaning applications.

All of these constraints result in downstream particle injection fluctuations from the capillary condenser and within the coaxial propellant gas mixing nozzle—resulting in cleaning or cooling spray composition fluctuations in the lower saturated liquid $CO_2$ injection ranges of between 0.1 and 3 pounds per hour per nozzle. Although the fluctuations do diminish as the liquid $CO_2$ injection rate is increased, which is wasteful, it is common to have spray instability below capillary injection rates of 3 to 5 pounds $CO_2$ per hour using a 0.030 inch ID capillary condenser, for example.

$CO_2$ Composite Spray fluctuations are problematic for applications requiring precise process control—for example fixed precision cleaning rates or cooling rates. A reactive control scheme is employed in conventional $CO_2$ Composite Spray applications to minimize, but cannot eliminate, spray fluctuations. A reactive control scheme compensates for upstream fluctuations in saturated liquid $CO_2$ supply pressure, temperature and density, as well as capillary condenser fluxes discussed above, which in turn dampens spray fluctuations caused by variable capillary $CO_2$ particle-gas production rates during injection into the heated propellant gas. A reactive control scheme controls a $CO_2$ Composite Spray composition by monitoring and controlling the composite spray mixing temperature (cold $CO_2$ particles mixed with hot propellant gas). A certain amount of particles plus a certain amount of heated propellant gas produce a certain mixing temperature. Typically the propellant pressure, temperature and flow rate are held somewhat constant and the saturated liquid $CO_2$ injection rate into the capillary condenser is adjusted to maintain the mixing temperature between an upper control limit (UCL) and a lower control limit (LCL). For example, typically the capillary injection flow rate is maintained between 5 to 8 pounds liquid $CO_2$ per hour for a coaxial spray equipped with a 0.030 inch ID capillary to achieve optimal spray stability control. The problem with reactive control is that the spray mixing temperature must be measured at a distance downstream from the nozzle exit to assure a fully mixed composite spray. This involves an off-line and time-delayed temperature measurement and metering valve adjustment period. Moreover this procedure is not real-time and is basically always drifting out of control above or below the UCL and LCL set points. Finally, the PC or PLC, software and automated temperature measurement and mechanical valve controls needed for this reactive control scheme add significant cost and complexity to a $CO_2$ Composite Spray system.

The prior art has relied on various $CO_2$ spray generation, monitoring and control schemes. The cleaning sprays produced by the prior art habitually drift during use, and variably produce either too lean or too rich $CO_2$ cleaning sprays. Conventional $CO_2$ treatment sprays must be re-calibrated frequently through either by-eye manual adjustments or automatic adjustment using temperature-based spray composition measurements in combination with servo-controlled metering valves.

As such there is a present need for generating and delivering a continuously stable, more powerful, and ultra-lean (particle density) $CO_2$ Composite Spray. Moreover, $CO_2$ spray technology is needed that can provide the following characteristics and benefits:

1. Ultra-lean $CO_2$ spray compositions with more numerous submicron particles;
2. A faster and more stable spray adjustment;
3. Higher spray cleaning power (or cooling capacity);
4. Faster cleaning (or cooling) rates;
5. A lower spray cost; and
6. A lower energy usage.

SUMMARY OF THE INVENTION

A method and apparatus is disclosed herein for the precision production and delivery of microscopic quantities of minute and highly energetic solid carbon dioxide ($CO_2$) particles having uniform density and distribution for use in a $CO_2$ Composite Spray system. The fluid pressure of liquid carbon dioxide in a capillary condenser assembly, conventionally in the range of between 750 psi and 900 psi (i.e., saturated liquid $CO_2$), is compressed to a hydraulic pressure of greater than 900 psi, and preferably between 1,000 psi and 5,000 psi, and above, to form a supersaturated liquid (or supercritical) $CO_2$ feedstock having a controlled and optimal liquid or liquid-like $CO_2$ density and temperature. A high pressure micro-capillary condenser assembly is used to efficiently convert precise quantities of supersaturated liquid $CO_2$ at ultra-low flow rates into a uniform mass, density and distribution of minute and highly energetic solid carbon dioxide particles. High pressure micro-capillary assemblies or bundles comprising one or more capillaries assembled in a parallel-flow arrangement provide a simple and novel mass flow range control means from near-zero to 15 pounds $CO_2$ per hour per capillary bundle, or more, without degradation of precision $CO_2$ injection and mass flow control. A novel spray nozzle is disclosed for modifying the size of $CO_2$ particles injected into a dense fluid propellant gas to provide an in-situ and infinitely-adjustable range of energetic cleaning or cooling sprays. Novel Vortex- and Peltier-based systems are used to produce and supply small volumes of saturated liquid $CO_2$ feedstock for practicing the present invention.

It is an object of the present invention to provide an improved $CO_2$ Composite Spray cleaning system;

A further object of the present invention is to provide an improved capillary condenser process and apparatus operating under supersaturation or supercritical conditions at pressures greater than 900 psi, and preferably in the range between 1000 and 5000 psi, or more, and at a temperature of between 70 degrees F. and 100 degrees F. regardless of the pressure and temperature of the saturated liquid carbon dioxide in a supply line;

Another object of the present invention is to use high capillary fluid pressure and adjustment thereof to provide precise mass flow control in the range between near-zero to 3 pounds $CO_2$ per capillary condenser element;

Another object of the present invention is to provide an improved $CO_2$ Composite Spray composition control using one or more high pressure micro-capillaries in a parallel-flow bundle to provide an adjustable mass flow range with high pressure-regulated flow control;

Another object of the present invention is to provide a method and apparatus for $CO_2$ Composite Spray capable of removing contaminants such as particles, residues and heat from delicate surfaces without damage to the surface using minuscule amounts of microscopic solids at very low composite spray pressures and propellant flow rates;

Another object of the invention is to provide a $CO_2$ Composite Spray system capable of capillary condensation and injection pressures of up to as high as 10,000 psi for increasing the production and injection velocity of the solid carbon dioxide particles, thus decreasing coaxial propellant velocity drag and increasing the available kinetic energy in the $CO_2$ Composite Spray stream to enable removal of strongly adhered contaminants by carbon dioxide spraying without damage to the surface being sprayed;

Another object of the present invention is to provide a novel method for conveniently adjusting the particle size of minute amounts of $CO_2$ particles, produced during high pressure micro-capillary condensation; and Another object of the present invention is to provide energy efficient low-volume methods and apparatuses using Vortex and Peltier technologies for condensing and delivery small volumes of saturated liquid $CO_2$ from $CO_2$ gas for use in the high pressure micro-capillary condensing system.

Briefly the present invention uses one or more high-pressure joule-Thomson micro-capillary condensers to efficiently produce microscopic amounts of solid $CO_2$ particles from a supersaturated liquid $CO_2$ which are then mixed into and accelerated to near-sonic velocities using a heated clean dry air propellant gas. High pressure micro-capillary condenser assembly is used herein as both a mass control device and a liquid-to-solid condenser device.

One or more micro-capillaries are used within the same capillary condenser assembly under supersaturation pressure conditions to achieve precision pressure-regulated mass control while allowing for changes in incremental changes in mass flow range. The result is significantly more precise control with ultra-low usages of liquid $CO_2$ than achieved today using a conventional $CO_2$ spray technologies, including the $CO_2$ Composite Spray which typically ranges between 3 and 15 pounds of $CO_2$ per spray nozzle per hour.

To achieve precise control at very low mass flows, the present invention utilizes a significantly greater capillary fluid pressure (supersaturated liquid carbon dioxide) than the conventional saturated gas-liquid capillary fluid feed pressures used in a conventional $CO_2$ Composite Spray, which ranges between 750 psi and 900 psi.

The present invention has the additional advantage of significantly improving and maintaining low $CO_2$ particle mass flows to near-zero flow rates using significantly less propellant mass flow to controllably accelerate microscopic amounts of particles to near-sonic velocities.

The present invention increases spray stream particle densities and coaxial propellant injection velocities in the range between 0.1 pounds per hour and 1.5 pounds per hour, or more, per micro-capillary using supersaturated liquid $CO_2$ per capillary condenser at a controlled fluid feed pressure of between 900 psi and 10,000 psi and at temperatures of between 10 degrees C. and 38 degrees C., and preferably at a pressure range of between 1000 psi and 5,000 psi and at temperatures of between 20 degrees C. and 30 degrees C. (for supersaturated liquid $CO_2$). Micro-capillaries may be "bundled" in a parallel-flow arrangement to increase mass flow without degrading pressure-regulated flow control. For example, combining one or more high pressure micro-capillaries having an internal diameter (ID) of 0.005 inch in a parallel-flow bundled assembly allows for increasing the pressure-regulated mass flow range linearly and incrementally. For example: 0.5 to 1.5 pounds per hour using one (1) 0.005 inch ID capillary, 12 inch length, 1000-1500 psi injection control range; 1.0 to 3 pounds per hour using two (2) 0.005 inch ID capillaries, 12 inch length, 1000-1500 psi injection control range; 1.5 to 6 pounds per hour using three (3) 0.005 inch ID capillaries, 12 inch length, 1000-1500 psi injection control range; and 2.0 to 12 pounds per hour using four (4) 0.005 inch ID capillaries, 12 inch length, 1000-1500 psi injection range, and so on.

Bundled segments may be directly integrated with the propellant mixing portion of the exemplary $CO_2$ Composite Spray coaxial spray system or more preferably may be transitioned to the propellant mixing portion over a longer distance using a transport capillary having a diameter equal to the sum of the individual internal diameters of the capillary bundle and integrated with a novel $CO_2$ composite spray nozzle of the present invention.

Finally, efficient Vortex- and Peltier-based $CO_2$ gas-to-liquid condensing methods and apparatuses are taught herein for producing and supplying small volumes of saturated liquid $CO_2$ for practicing the present invention.

Other objects and advantages of the present invention will become apparent from the following description and accompanying drawings.

BRIEF DESCRIPTION OF THE DRAWINGS

The accompanying drawings, which are incorporated into and form a part of the disclosure, illustrate prior art or an embodiment of the invention and, together with the description, serve to explain the principles of the invention.

The present invention will be best understood from the following description when read in conjunction with the accompanying drawings.

DETAILED DESCRIPTION OF THE INVENTION

Figure 1:
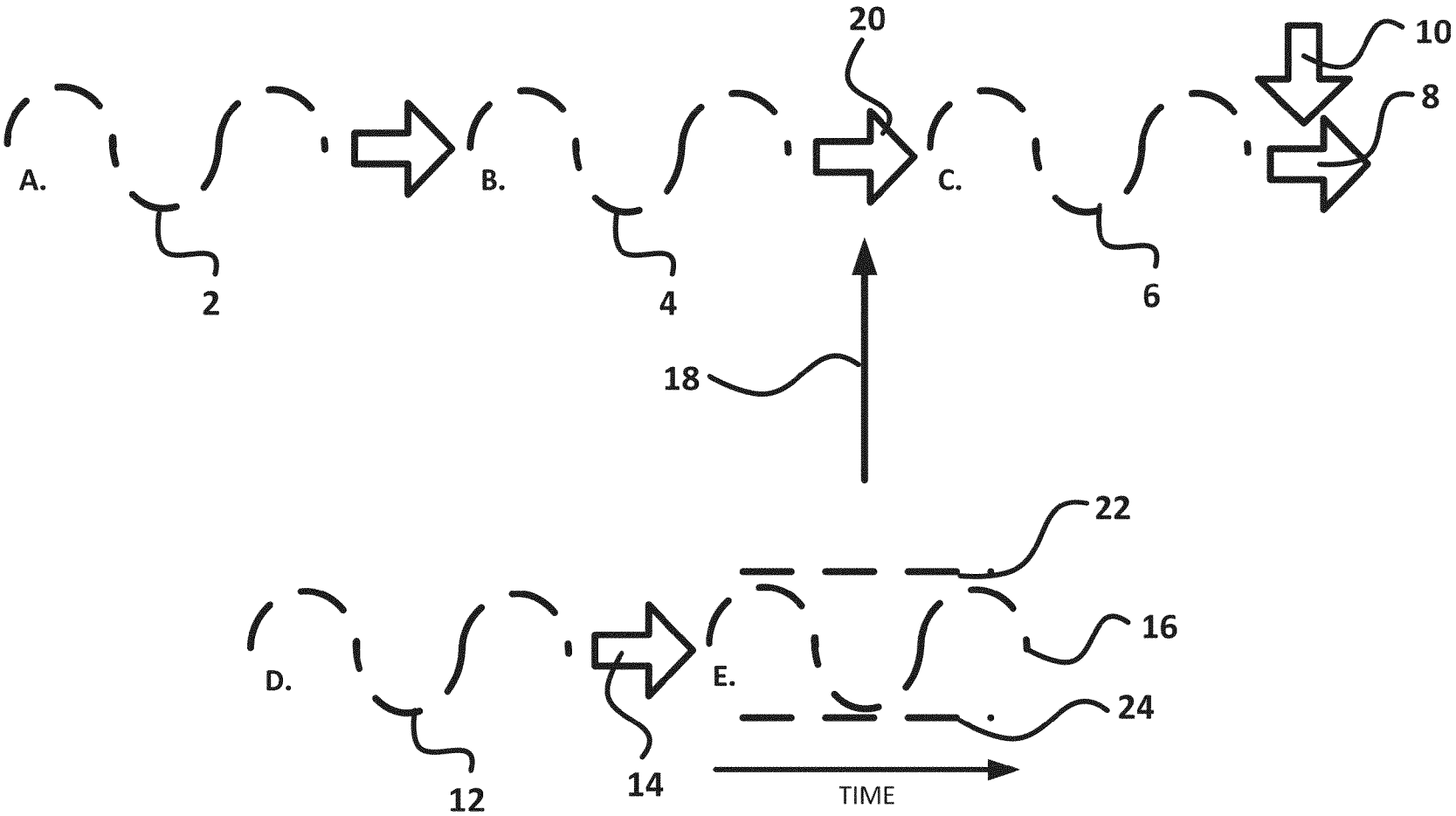
Fig. 1 PRIOR ART
FIG. 1 illustrates schematically the prior art enhanced Joule-Thomson capillary condensation technique and constraints regarding saturated liquid $CO_2$ mass flow and particle density control.

FIG. 1 illustrates schematically the prior art enhanced Joule-Thomson capillary condensation technique and constraints regarding saturated liquid $CO_2$ mass flow and particle density control. Referring to FIG. 1, the prior art as discussed herein fails to provide a stable source of saturated liquid $CO_2$ for capillary condensation processes to produce a consistent and stable supply of $CO_2$ particles for injection and mixing with a propellant gas, having a constant pressure and temperature. The reasons for this constraint are related to a number of contributing causes including; changes in bulk $CO_2$ gas supply tank pressures and temperatures during withdraw and usage, changes in environmental temperatures such as factory temperatures and outside storage tank and delivery system temperatures, temperature variations within the $CO_2$ gas supply lines from source to ceiling or floor to cleaning system, variations in high pressure gas delivery system supply pressures and temperatures, and variations in internal pressure and temperature of refrigerant condenser systems used to condense transported high pressure gas to a cold saturated liquid $CO_2$ supply.

Even with end-of-line pressure control regulators, ambient temperature and condenser system fluctuations still result in a pressure and temperature variability, which is somewhat sinusoidal in nature. This results in a highly variable and somewhat unpredictable pressure and temperature swings of a saturated $CO_2$ feedstock (2) which results in variable liquid density (4), variable capillary boiling densities and resulting variability in particle size and density (6), and upon injection (8) and mixing with a heated propellant gas (10), produce a variable spray composition (12) of $CO_2$ particles and propellant gas which when projected (14) at a surface produce a variable cleaning (or cooling) rate (16).

The conventional control means involves a reactive scheme (18), whereby the spray is periodically measured—for example by mixing temperature as discussed herein—and the capillary injection rate (20) is adjusted manually or automatically to maintain the $CO_2$ Composite Spray composition (12) within an acceptable upper control limit (22) and lower control limit (24) over time. The prior art constraints thus described are exacerbated with extremely low liquid $CO_2$ injection rates and capillary flows (small capillary diameters).

Figure 2:
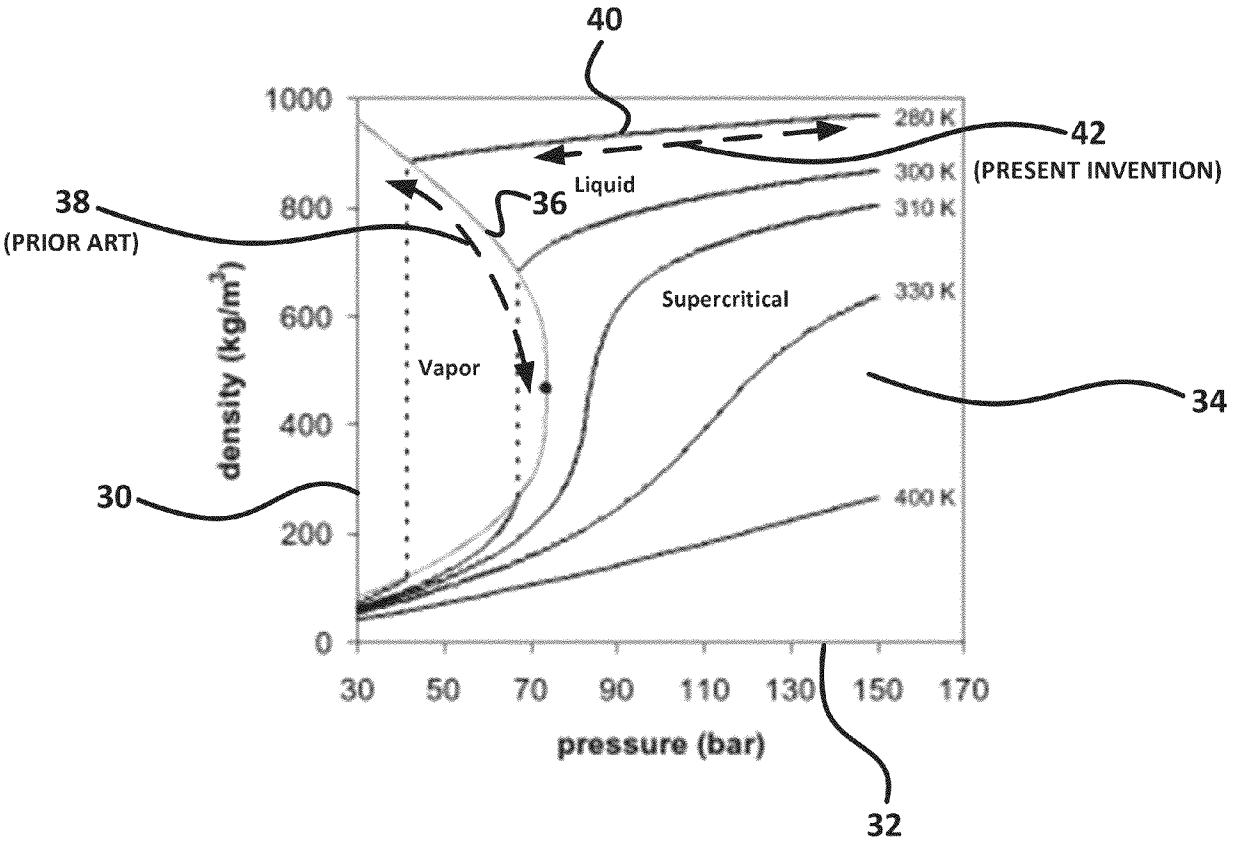
FIG. 2 schematically illustrates an embodiment of the present invention comparing and contrasting the highly variable saturated liquid $CO_2$ density as compared to a supersaturated liquid $CO_2$ feedstock used in the present invention.

Having thus described various spray control problems associated with conventional $CO_2$ Composite Sprays using a saturated liquid $CO_2$ feedstock, FIG. 2 schematically illustrates an embodiment of the present invention comparing and contrasting the highly variable saturated liquid $CO_2$ density as compared to a supersaturated liquid $CO_2$ feedstock used in the present invention.

The principal constraint with the prior art is a fluctuating saturated liquid $CO_2$ fluid density. As shown in FIG. 2, a graph correlating the capillary injection fluid density (30) with pressure (32) and temperature (34) illustrates the problem clearly. The liquid-vapor saturation boundary line (36) exhibits a density shift (38) of as much as 38% between a saturated liquid $CO_2$ pressure of between 40 atm and 70 atm and a temperature between 278 deg. K and 304 deg. K. By contrast, and as used in the present invention, a supersaturated boundary line (40) exhibits a density shift (42) of less than 3% between a supersaturated liquid $CO_2$ pressure of between 70 atm and 680 atm and a temperature between 278 deg. K and 298 deg. K.

Figure 3:
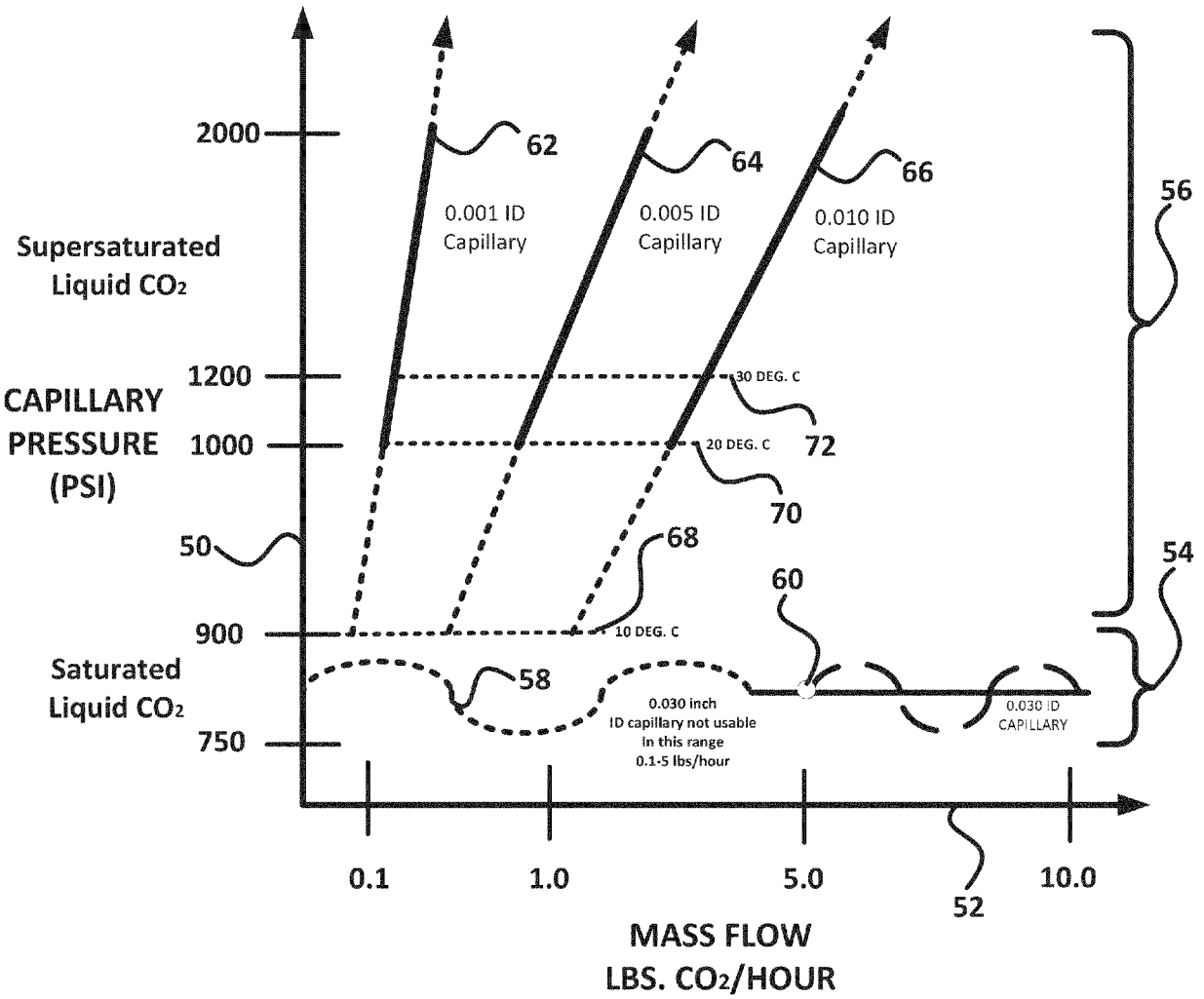
FIG. 3 illustrates an embodiment of the present invention for using supersaturated liquid $CO_2$ hydraulic pressure in combination with a micro-capillary or capillary bundle to control mass flow.

The supersaturated liquid $CO_2$ properties described under FIG. 2, and as used in the present invention, uniquely provide both a highly uniform and maximum fluid density over a very broad pressure range as well as a means for precise flow regulation using microscopic capillary condensers, described under FIG. 3.

FIG. 3 illustrates using supersaturated liquid $CO_2$ hydraulic pressure in combination with a micro-capillaries or capillary bundles to control $CO_2$ mass flow and particle density in contrast to an exemplary prior art control scheme using a variable saturated liquid $CO_2$ supply, 0.030 inch ID capillary, and a 18-turn micrometering valve. Shown in FIG. 3, capillary pressure (50) is correlated with $CO_2$ mass flow (52) for comparing and contrasting flow and mass regulation using an exemplary prior art metering valve control scheme (54) with the capillary pressure metering control (56) method of the present invention. The 18-turn micrometering valve control method (54) is ineffective in the range below 2 to 3 valve rotations, representing an highly unstable and therefore unusable flow control range (58) of between about 0.1 lbs. to 5 lbs. $CO_2$ per hour using a saturated liquid $CO_2$ supply of between 750 psi and 900 psi. As such, the prior art method using an optimized 0.030 inch ID Joule-Thomson capillary having a length of about 36 inches with saturated liquid $CO_2$ injection is suitable only for flow rates above about 5 lbs. $CO_2$ per hour per capillary (60), and still exhibits some pulsation near this lower injection rate limit. As discussed under FIG. 1, the 18-turn metering valve must be adjusted periodically to insure that the capillary particle production rate remains within a predetermined acceptable spray composition control range. Also as discussed herein, using capillaries much small than 0.020 inch ID (to lower flow rate range) with the prior art metering valve flow control means introduces constraints such as lack of precise micro-flow control and fluctuation in particle generation. As such, there is need for enabling more predictable and precise mass and particle flow in the lower ranges between near-zero and 5 lbs. $CO_2$ per hour per capillary.

The present invention employs a novel capillary pressure metering control method and apparatus. Small capillaries having internal diameters of between 0.001 inch ID and about 0.020 inch ID, and lengths of between about 6 inches to about 36 inches, or more, are used in singular or in parallel bundles to provide both mass flow control and high pressure Joule-Thomson condensation using high pressure-regulated supersaturated liquid $CO_2$ injection. Using this novel metering method and apparatus, precise and stable control of miniscule amounts of $CO_2$ flow and particle generation is enabled in the range between near-zero and 5 lbs. per hour per capillary. Now referring to FIG. 3, three exemplary capillaries; a 0.001 inch ID capillary (62), a 0.005 inch ID capillary (64), and a 0.010 inch ID capillary, each have similar lengths. As shown in FIG. 3, a 0.001 inch ID capillary (62) produces a very narrow flow range of between approximately 0.1 and 0.3 lbs. per hour over a fluid pressure range of between about 1000 psi and 2000 psi. A 0.005 inch ID capillary (64) produces a very narrow flow range of between approximately 0.5 and 2 lbs. per hour over a fluid pressure range of between about 1000 psi and 2000 psi. A 0.010 inch ID capillary (66) produces a very narrow flow range of between approximately 3 and 5 lbs. per hour over a fluid pressure range of between about 1000 psi and 2000 psi. This clearly illustrates the precision microscopic mass flow range control enabled by the present invention.

In addition, minimum injection pressures are shown under FIG. 3 and which are based up a predetermined and controlled supersaturated liquid $CO_2$ fluid temperature. Minimum injection pressures assure supersaturated liquid $CO_2$ conditions (highest constant liquid density) upon injection into a capillary or capillary bundle. Exemplary minimum injection pressures include, for example, about 900 psi for fluid temperatures of about 10 degrees C. (68), about 1000 psi for fluid temperatures of about 20 degrees C. (70), and about 1200 psi for fluid temperatures of about 30 degrees C. (72).

Moreover, parallel bundles of capillaries may be used to further extend the pressure-regulated mass control range thus described to 15 lbs. $CO_2$ per hour, or more, discussed under FIG. 4A.

Figure 4A:
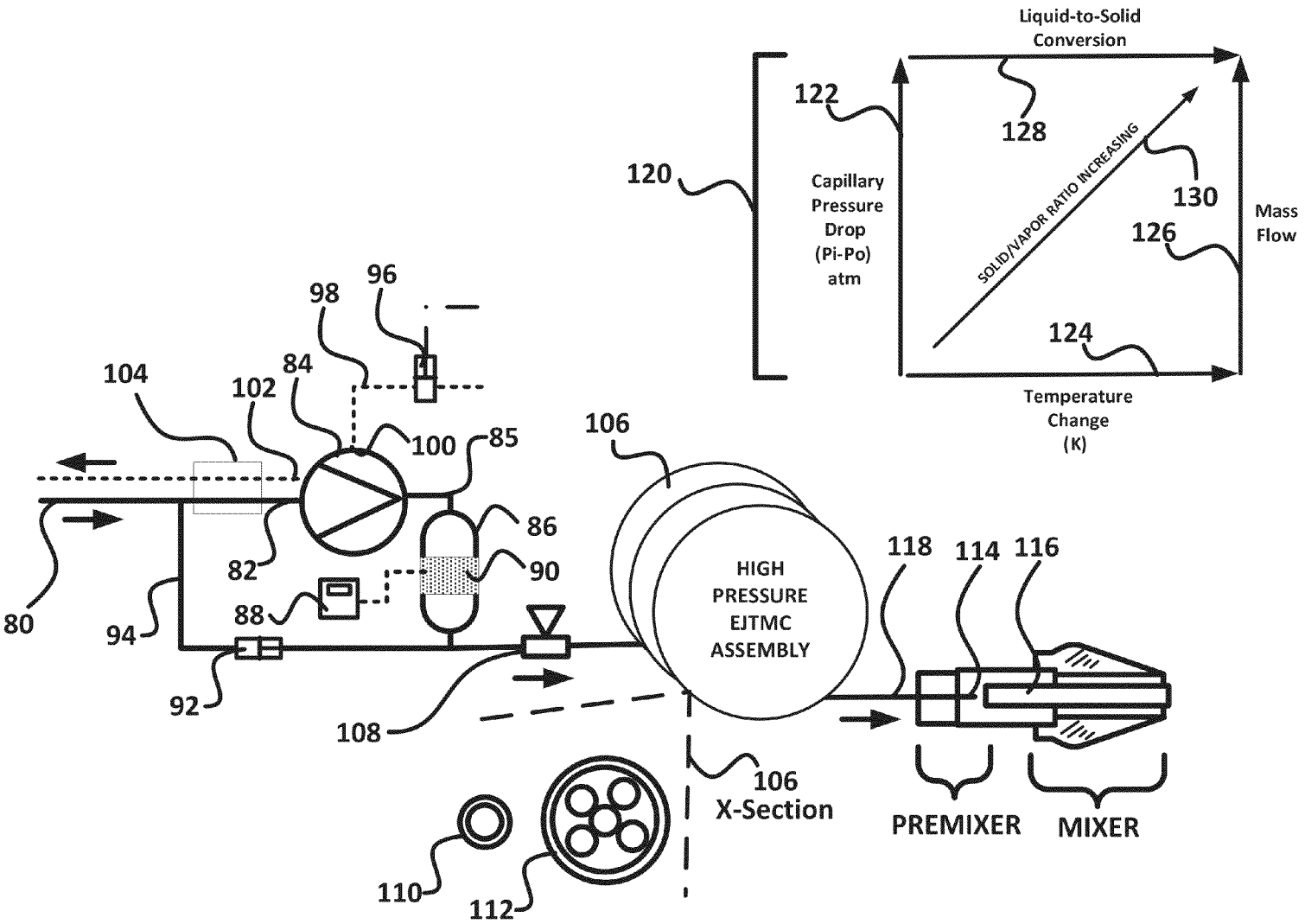
FIG. 4A schematically illustrates an embodiment of the present invention comprising an exemplary system to produce a supersaturated liquid $CO_2$ and produce particles therefrom using a high-pressure enhanced Joule-Thomson micro-capillary apparatus.

FIG. 4A schematically illustrates an embodiment of the present invention comprising an exemplary system to produce a supersaturated liquid $CO_2$ and with which to produce particles therefrom using a high-pressure enhanced Joule-Thomson micro-capillary assembly. The method and apparatus of FIG. 4A significantly improves the condensation process and conversion efficiency as compared to the prior art Enhanced Joule Thompson Capillary (EJTC) condenser methods and apparatuses of U.S. Pat. Nos. 5,725,154, 7,293,570, and 7,451,941. The high-pressure Joule-Thomson capillary condensation process herein provides improved production, control and injection of $CO_2$, particularly at very low flow rates, into heated propellant gas for cleaning and cooling applications. For example, the method and apparatus of U.S. Pat. No. '941, FIG. 1*a* (2), may be replaced with the improved method and apparatus of FIG. 4A.

Now referring to FIG. 4A, a suitable supply or feedstock of saturated liquid $CO_2$, contained and flowed through a supply tube (80), and typically having a variable vapor pressure of about between 750 psi and 1000 psi and a variable fluid temperature of between 50 degree F. and 75 degree F., is introduced into the inlet (82) of an exemplary air-driven hydraulic pressure amplifier (84). This may include for example a cylinder supply of liquid $CO_2$, a refrigerant-condensed $CO_2$ from a source of gaseous $CO_2$, and novel low-volume Vortex- and Peltier-based condenser systems described under FIGS. 7 and 8 herein. The saturated liquid $CO_2$ is compressed to a supersaturation pressure of between 1,000 psi and 10,000 psi and compressed into a supply of supersaturated liquid $CO_2$ and stored using a fluidly-connected (85) storage system comprising an insulated and temperature controlled high-pressure cylinder (86). Exemplary high pressure liquid pumps (84) suitable for use with the present invention include air-driven and air-regulated hydraulic amplifiers and boosters Haskel Pump Models numbers MS-7, MS-12, MS-21, AAD-5, AAD-7 and/or DSF-B15, available from Haskel International Inc, Burbank Calif. However other brands and types of air, electric or hydraulically driven pumps capable of pressurizing $CO_2$ gas or saturated liquid $CO_2$ into a supersaturated liquid $CO_2$ feedstock are suitable for practicing the present invention.

Thermally-insulated cylinders (86) may include simple high pressure pipe or ported sample cylinders having internal volumes adequate to ballast a feedstock supply of supersaturated liquid $CO_2$ without undue thermal changes in the fluid during use. Storage volumes and heating loads may be calculated based upon downstream capillary condenser demand (lbs. $CO_2$/hour). Thermal control is provided, for example, using a digital temperature controller (88) and a heating element wrapped or bolted about the storage cylinder (86), all of which is wrapped in a suitable thermal insulation media. Supersaturated fluid temperature is preferably controlled at a temperature of about 70 degrees F., or a few degrees above ambient temperature to insure stability with respect to the surrounding environment. This insures a stable and consistent supersaturated liquid $CO_2$ density.

However, for longer micro-capillary condenser lengths of 20 feet or more it may be useful to feed the capillary segment or capillary bundle condenser assembly described herein using supercritical $CO_2$ at a temperature of about 88 degrees F., or higher, and at a much higher injection pressure of 2,500 psi or more. The combination of zero surface tension, extremely low viscosity, and high fluid density enables a more gradient condensation process within longer, smaller capillary condensers. Supercritical $CO_2$ injection uniquely transitions the feedstock through three stages of cooling, condensation, and crystallization: supercritical→liquid→solid, providing a much larger pressure and temperature gradient for longer capillary condensers.

A spring-loaded pressure relief valve or automated gate valve (92) may be used to maintain a constant pressure within the storage cylinder (86), allowing excess fluid volume to relieve and return (94) to the saturated (or supercritical) feedstock supply line (80).

The exemplary air-driven hydraulic booster pump (84) is controlled using a manual or automatic air drive system. Using a manually-adjustable or automated digital pressure regulator (96), compressed air (100) is regulated between 20 psi and 150 psi and fed (98) into the air drive section of the pump (84). Pump drive air-regulation correlates roughly linearly to compressed fluid output pressure, and depending upon the pump selected, will control $CO_2$ fluid pressures between 900 psi and 10,000 psi. Upon drive air compression and expansion from the air drive exhaust section (102) of the pump (84), the expanding drive air cools significantly in accordance with Joule-Thomson expansion cooling principles. This cooling capacity may be used in the present invention within a countercurrent intercooler assembly such as a tube-tube heat exchanger (104) to cool and densify the saturated liquid $CO_2$ feedstock contained in the supply line (80).

Following the generation of a supply of supersaturated liquid $CO_2$ (or supercritical $CO_2$), the supersaturated fluid is metered using a micro-capillary segment or micro-capillary condenser bundle (106), called a High-Pressure Enhanced Joule Thomson Micro-Capillary condenser assembly (or abbreviated as EJTMC assembly herein). Turning the metering on and off is accomplished using an automated valve (108), for example a Series 9 or 99 pulse valve available from Parker Hannifin, Fairfield, N.J., which is fluidly connected in-line between the storage cylinder (86) and the EJTMC assembly (106).

The EJTMC assembly comprises a capillary loop having a length of between 6 inches and 30 feet, or more, and internal diameters preferably between 0.001 inch and 0.015 inch, called micro-capillaries herein. As shown in FIG. 4A, micro-capillaries may be "bundled" in a parallel-flow arrangement to increase mass flow without degrading pressure-regulated flow control. For example, a single micro-capillary (110) having an 0.005 inch ID capillary, at 12 inch length, will provide a precision flowrate of about 0.5 to 1.5 pounds per hour between an injection pressure range of 1000-1500 psi. In another example, a bundled micro-capillary assembly (112) comprising four (4) 0.005 inch ID capillaries, 12 inch length, will provide a precision flowrate of about 2 to 12 pounds per hour within the injection pressure range of between 1000-1500 psi.

Single EJTMC micro-capillary or bundled EJTMC assemblies (106) are fluidly connected (114) via a coaxial premixer (i.e., micro-capillary fed coaxially within a portion of the dense fluid propellant tube) and into a dense fluid propellant mixer assembly (116) of the exemplary $CO_2$ Composite Spray coaxial spray system, for example as described under FIG. 2*a* of U.S. Pat. No. '941, or alternatively may be transitioned to and fluidly connected to said propellant mixing portion over a longer distance using a transport capillary segment (118) having a diameter equal to the sum of the individual internal diameters of the capillary bundle. Preferably, single EJTMC micro-capillary or bundled EJMTC assemblies are fluidly connected to the exemplary expansion, positioning and mixing spray nozzle described under FIG. 4B herein.

Regarding the exemplary capillary bundle-to-transport capillary transition method thus described, it is important not to expand the micro-capillary fluids quickly using a segmented and expanding capillary apparatus such as taught in U.S. Pat. No. '570, as this will cause clogging and sputtering, among other undesirable effects. Given the small internal diameters of capillaries used in the present invention, a gradual pressure drop along a uniform capillary condenser volume is preferred to allow the microscopic quantity of supersaturated liquid carbon dioxide to gradually boil, cool and condense into a free-flowing and uniformly dispersed mixture of uniformly sized microscopic $CO_2$ solid particles and $CO_2$ vapor. For example a high-pressure capillary bundle containing four (4) 0.005 inch ID capillaries in parallel (having an ID sum of d1+d2+d3+d4=0.020 inch) may be affixed to a 0.020 inch ID transport capillary segment thus forming a uniform capillary bundle-to-transport capillary volume transition. Thus the capillary bundle serves as both a high-pressure injector and flow restrictor; a novel Joule-Thomson throttle. By contrast, incremental and sequential capillary volume change as used in U.S. Pat. No. '570 (FIG. 2) uses a segmented sequence of serially-connected capillaries having increasing internal diameters (d) of d1<d2<d3<d4 and so on which produces abrupt volume increases for rapid expansion and condensation of saturated liquid carbon dioxide first into a mass of small crystals (d1) which then coalesce and grow along each expansion step (d2, d3 and d4) into an aerosol containing fewer particles (low density) but having a much larger average particle size. The crystal growth process of U.S. Pat. No. '570 is analogous to a snowball gathering size and mass as it rolls downhill or the coalescence of freezing microscopic rain droplets into large hail on their downward descent from the upper atmosphere. Such a particle growth technique is undesirable in the present invention as it causes excessive particle growth and results in low and non-uniform particle distributions or densities within a $CO_2$ Composite Spray. As such, the present invention prevents abrupt pressure drops and excessive expansion cooling immediately following high-pressure supersaturated liquid $CO_2$ capillary injection. Supersaturated liquid $CO_2$ boils (cools) gradually and uniformly within and along a capillary segment under very high pressure gradients. There is no sputtering or clogging and mass flow (microscopic particle generation) is controlled using a combination of variably-controlled high fluid pressure and micro-capillary bundles.

Referring to the graphical relationship chart (120) under FIG. 4A, a high pressure, supersaturated liquid $CO_2$ (or supercritical $CO_2$) condensation process using an EJTMC micro-capillary system thus described increases capillary pressure drop (122), increases capillary temperature drop (124), controls capillary mass flow (126), and all of which increases Joule-Thomson cooling and condensation processes (128). As such the method and apparatus of FIG. 4A increases the production of microscopic and minute solids (130).

By contrast, the $CO_2$ Composite Sprays discussed in the prior art—which employ one or more capillaries having internal diameters of, for example, 0.020, 0.030, 0.040, 0.060, and 0.080 inch in combination with a micrometering valve and using saturated liquid carbon dioxide—cannot provide precision mass control (and production of uniform microscopic $CO_2$ particles) and linearity through the entire mass flow range from near-zero flows to the maximum flows. Using capillaries with internal diameters below 0.020 inches does produce a smaller mass flow of smaller particles, but also produces inconsistent particle flows (i.e., increased pulsing, sputtering and sublimation losses) when expanded into larger diameter capillary segments. For example, smaller mass flows comprising smaller-sized $CO_2$ particles are more susceptible to heating and sublimation within the longer or stepped capillary transitions present in the prior art (i.e., U.S. Pat. No. '570). As such, much of the cleaning or cooling agent (solid $CO_2$ particles) is destroyed (sublimated) in transit and prior to introduction with the propellant gas, which itself further sublimates a portion of the surviving $CO_2$ particle population prior to impacting surfaces under spray treatment.

Figure 4B:
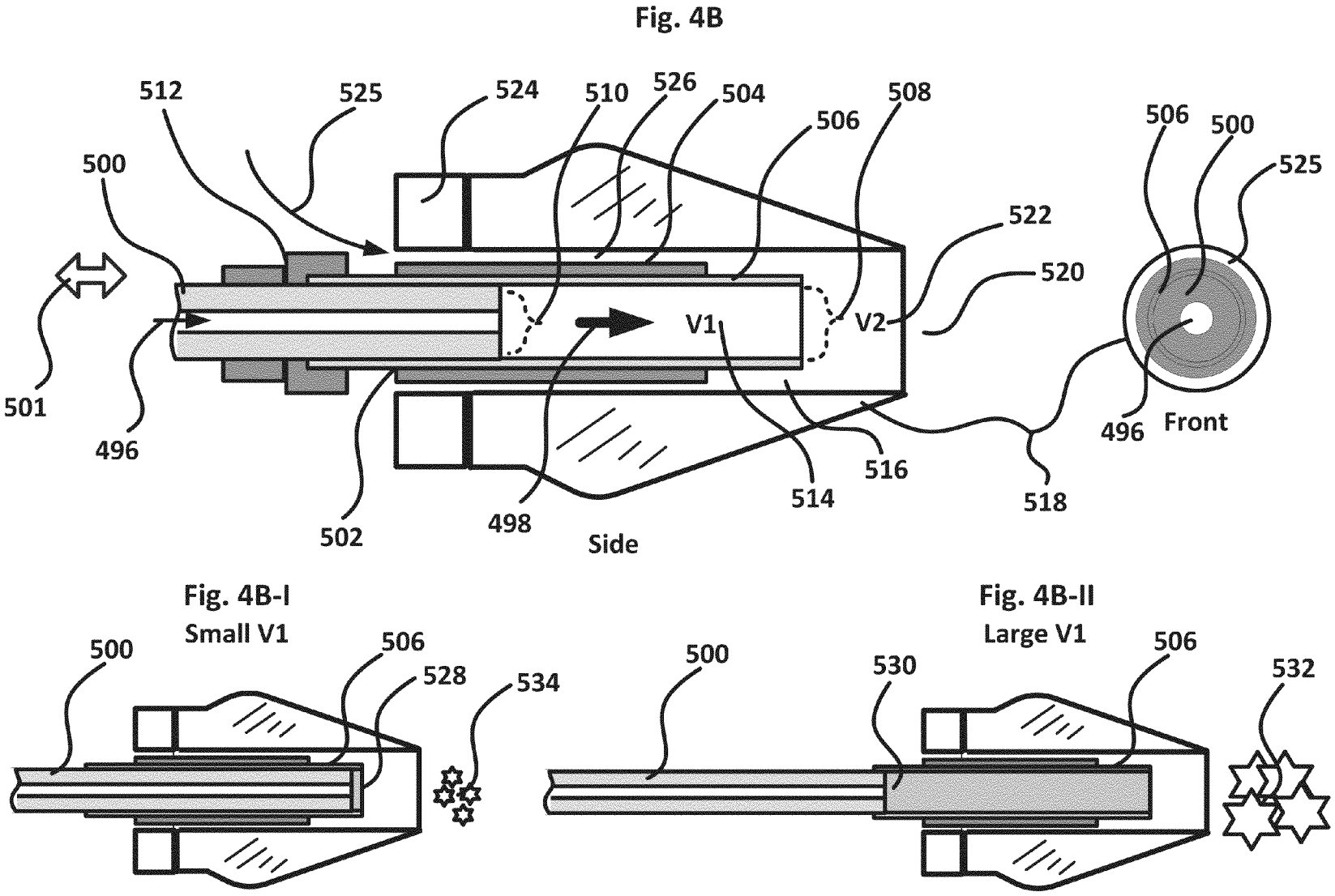
FIG. 4B schematically illustrates an embodiment of the present invention comprising an exemplary expansion-propulsion nozzle for precisely adjusting the size of minute $CO_2$ particles prior to injection into a propellant gas stream.

Having thus described the preferred embodiments of the high-pressure EJTMC condenser assembly for producing minute amounts of microscopic $CO_2$ crystals, FIG. 4B schematically illustrates a dense fluid particle-propellant mixing and spray delivery nozzle (also referred to as a "mixer") embodiment of the present invention. The present embodiment provides several useful functions in the present invention. In a first aspect of the present embodiment, $CO_2$ microcrystals (and cold dense vapor) produced by the EJTMC apparatus and process of FIG. 4A are modified further to increase particle size through an adjustable (in-situ) supercooling and crystal-growth process. In a second aspect of the present embodiment, the pressure and flow of the $CO_2$ particle stream are mechanically balanced with the pressure and flow rate of a propellant gas stream to optimize $CO_2$ particle acceleration and particle conservation (i.e., avoid excessive turbulent mixing). In a third aspect of the present embodiment, the $CO_2$ particle stream is injected within the spray nozzle body (and into the propellant gas stream) through a precise mechanical alignment of both the internal coaxial and longitudinal orientations.

The EJTMC apparatus and process described under FIG. 4A produces a very small amount of relatively high-pressure, fast-moving, and ultra-fine $CO_2$ particles—also termed "microseeds"—entrained in cold $CO_2$ vapor, which is discharged at the terminal end of the high-pressure EJTMC condenser assembly (FIG. 4A (106)). $CO_2$ microseeds produced by the present invention are grown (crystallized) into a useful size within a short and small-volume expansion tube. Following this, grown crystals and residual $CO_2$ vapor are injected coaxially at a precise location within the propellant stream, and with pressure balancing and precise coaxially injection within the mixing zone of the spray nozzle. The cold micro-particle and vapor mixture is injected into an adjustable expansion micro-chamber, whereupon the cold $CO_2$ microseeds accumulate particle mass according to the following mechanism—rapid pressure and temperature drop during sudden expansion cause dense cold vapor to condense onto the solid phase microseeds as a cold boiling liquid film, which then condenses further to a frozen solid surface layer. The expansion-cooling-condensing process occurs within a very short traverse and rather small expansion volume. The expansion volume determines the amount of crystal growth, and the particles grow layer-upon-layer until finally injected into and mixed with the propellant stream at the terminal end of the expansion tube. Additionally, the higher pressure, low-flow $CO_2$ microseeds and vapor discharged from the EJTMC condenser assembly (FIG. 4A (106)) and expanded mixture of $CO_2$ microseeds and vapor produced by the expansion chamber must be balanced with the relatively high-flow, lower pressure propellant gas within the spray nozzle assembly to eliminate turbulence. In this regard, the expansion tube assembly of the present embodiment provides the capability of mechanically adjusting (or balancing) the pressures and flows between the two streams during mixing.

Now referring to FIG. 4B, minute amounts of $CO_2$ microseeds and dense cold $CO_2$ vapor as depicted by the small arrow (496)—flowing within a moveable or position-adjustable capillary segment (500) as depicted by the double arrow (501)—is selectively coalesced and condensed as depicted by a larger arrow (498) at various positions within and along the longitudinal traverse of a thermally-insulated (optional) rigid expansion tube (502), which may be grounded to dissipate electrostatic discharge build-up during the expansion process. The adjustable expansion tube assembly (502) may be constructed for example using full or partial heat-shrinkable Teflon insulation (504) covering a stainless capillary tube (506). The stainless capillary tube (506) has a slightly larger inside diameter (508) as compared to the outside diameter of the capillary injection tube (510). Given this arrangement, the inner capillary tube (500) may be selectively re-positioned anywhere along the interior within the rigid expansion tube (506). An elastomeric nut and flangeless ferrule sealing assembly (512), for example, may be used to secure the capillary segment (500) to the expansion tube (502). The moveable capillary segment (500) and rigid expansion tube (506) thus forms an adjustable and microscopic expansion volume (514) therein, designated as "V1". The rigid expansion tube (506) itself is positioned within the throat (516) of an outer coaxial propellant nozzle (518) near the discharge position (520) of the propellant nozzle—thus forming an adjustable particle-propellant mixing volume (522) therein, designated as "V2". An elastomeric nut and flangeless ferrule sealing assembly (not shown), for example, may be used to secure and the expansion nozzle assembly (502) to the propellant nozzle assembly (524). A dense fluid propellant gas (525) such as clean dry air, nitrogen, or carbon dioxide is heated between about 60 degrees F. to about 300 degrees F. and flows coaxially (526) over the optionally insulated rigid expansion tube assembly (502), mixes with and accelerates the expanded $CO_2$ particles from the nozzle exit (520).

FIGS. 4B-I and 4B-II describe the operation of the novel expansion apparatus described under FIG. 4B. The moveable capillary segment (500) may be positioned anywhere from the terminal end (FIG. 4B-I, 528) of the rigid expansion tube (506) to the inlet portion (FIG. 4B-II, 530) of same. The length of the rigid expansion tube (506) is preferably constructed to be between about 0.5 inches to 8 inches in length with inside diameters of between about 0.0625 inches to 0.250 inches to accommodate moveable capillary segments having slightly smaller outside diameters—for example from about 0.06 inches to 0.20 inches. Other combinations (i.e., lengths and diameters) of capillary segment (500) and expansion tube (506) may be used which meet the adjustability requirements discussed herein. A larger expansion volume—V1 (FIG. 4B, 514)—produces larger $CO_2$ crystals (FIG. 4B-II, 532). A smaller expansion volume—V1 (FIG. 4B, 514)—produces smaller particles (FIG. 4B-I, 534). As such, and using the present embodiment, the particle size is adjustable from fine (small V1) to coarse (large V1) using a simple moveable tube-within-tube expansion device as described. The present embodiment also serves as a precision particle-into-propellant injection-alignment tube. The mixing volume—V2 (FIG. 4B, 522)—and propellant gas (FIG. 4B, 525) flowrate (pressure) are balanced—via in-situ adjustment of the expansion tube (FIG. 4B, 506) within the nozzle throat (FIG. 4B, 516) to accommodate the differences between expanded fluid pressure-flow and dense fluid propellant gas pressure-flow.

The $CO_2$ particle growth methods of the prior art and developed by the first named inventor are not suitable for use with the present invention. The following discussion compares and contrasts the novel particle size adjustment apparatus of FIG. 4B, FIG. 4B-I, and FIG. 4B-II to the expansion apparatuses described under U.S. Pat. No. 5,725,154 ('154) and U.S. Pat. No. 7,134,946 ('946).

Figure 10:
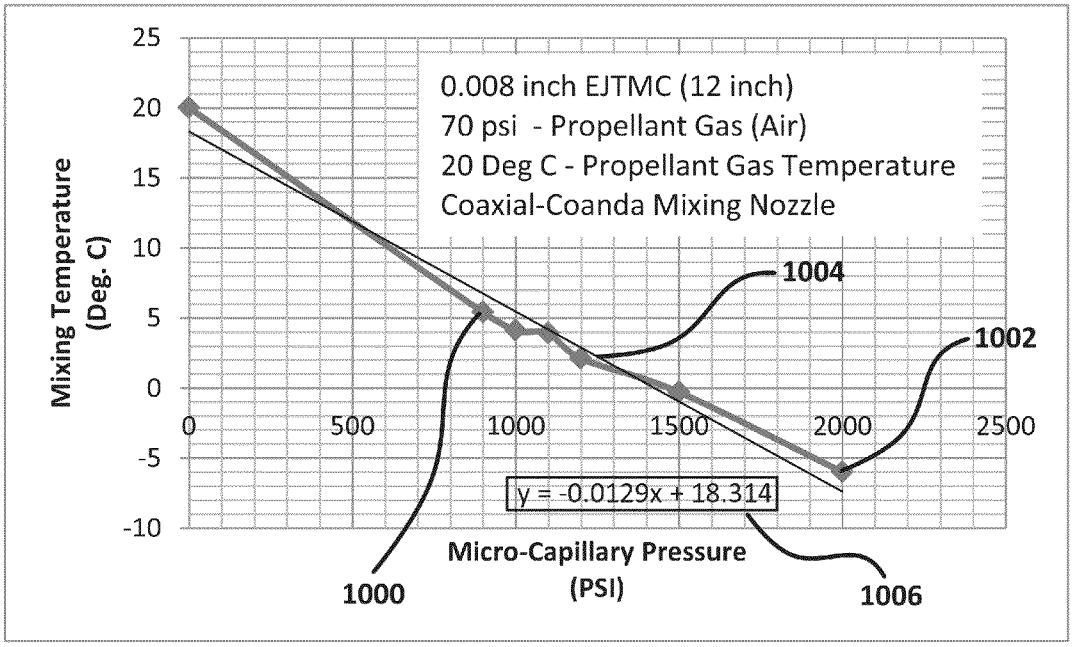
FIG. 10 is a graph showing the relationship between spray mixing temperature and capillary pressure.

The apparatus of '154 moves a propellant nozzle body ('154, FIG. 10, (14)) over an inner fixed-position snow tube ('154, FIG. 11, (22)). Further to this, the apparatus described under '154 utilizes a threaded adjustment section ('154, FIG. 10, (14)) to provide a $CO_2$ particle-gas expansion volume change. Threaded adjustment features produce microscopic particles during tuning and thus are not acceptable for precision particle removal applications. In addition, the expansion volume used in '154 utilizes a divergent cavity ('154, FIG. 11, (136)), which produces highly non-linear pressure gradients and which is subject to "clogging" or "sputtering" when fully opened (largest expansion volume). By contrast the device of FIG. 4B is a cleaner device—utilizing a tube-in-tube adjustment and flangeless ferrule sealing mechanism—and produces a linear volume-pressure gradient during adjustment. Further to this the expansion device provided under FIG. 4B has a larger range of particle size control as compared to a divergent expansion cavity of '154.

Now referring to '946, various lengths and increasing diameters ('946, FIG. 6) of flexible PEEK tubing are connected in series to form any variety of expansion tube assembly contained with a propellant tube. The '946 expansion system is cumbersome, cannot be adjusted in-situ, and does not provide precise propellant injection control. Moreover, neither the individual expansion segment volumes nor the terminal positioning of the expansion system are adjustable in-situ within the propellant tube. For example, the $CO_2$ particle expansion system of '946 (FIG. 6) requires complete disassembly of the coaxial spray applicator device shown in '946 (FIG. 5), removal of the old stepped expansion tube assembly and installation of a new stepped expansion tube assembly, and reassembly of the entire coaxial spray applicator system to accomplish changes in the $CO_2$ expansion and crystallization process. Still moreover, the entire capillary condenser system must be aligned with the propellant nozzle to balance capillary and dense fluid propellant gas pressures and flows. Moreover, the stepped arrangement of '946 is impractical for use with microscopic amounts of liquid carbon dioxide used in the present invention. The minute amounts of microscopic $CO_2$ particles generated in the present invention would entirely sublimate during the long expansion distance prior to the propellant injection point. Further to this, a separate centering device is required to position the terminating flexible capillary segment of '946 within the terminal end of the spray nozzle.

Figure 5:
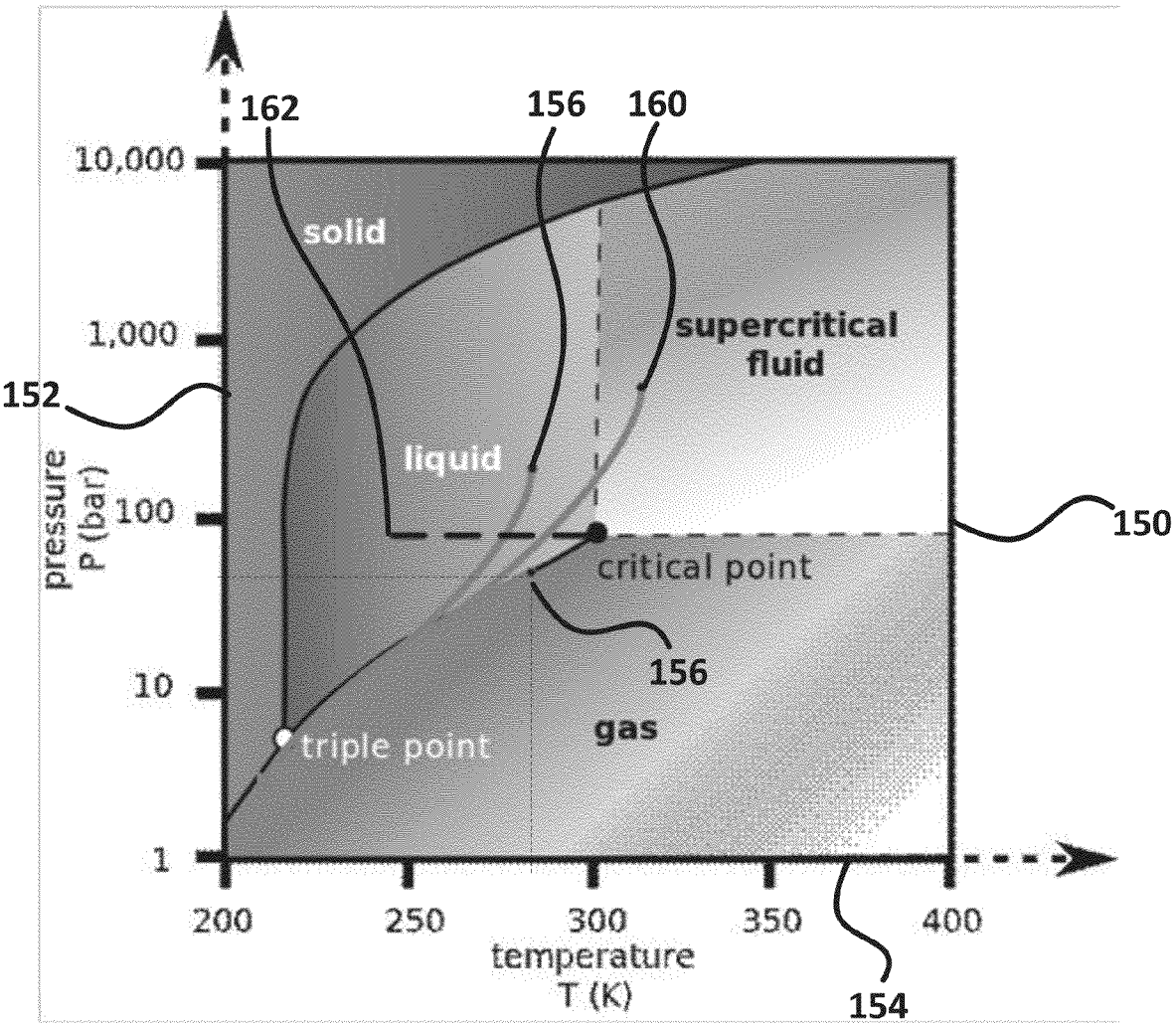
FIG. 5 schematically illustrates the differences between a saturated liquid $CO_2$, supersaturated liquid $CO_2$, and supercritical $CO_2$ using a phase diagram.

FIG. 5 schematically illustrates the differences between a saturated liquid $CO_2$, supersaturated liquid $CO_2$, and supercritical $CO_2$ using a phase diagram. The phase diagram (150) shows the various phases for CO2 based upon pressure (152) and temperature (154). The vapor-liquid saturation line (156) represents the boiling P-T curve line for a conventional capillary condenser utilizing gas-saturated liquid $CO_2$, typically ranging somewhere along the saturation line (156) between a pressure range of about 750 psi to 875 psi and between a temperature range of about 10 degrees C. and 25 degrees C. By contrast, the present invention utilizes high pressure $CO_2$ fluids—supersaturated liquid (158) or supercritical $CO_2$ (160)—above the saturation line, typically above the $CO_2$ critical pressure line (162) of 1070 psi, between a pressure range of about 900 psi to 10,000 psi and between a temperature of about 10 degrees C. and 35 degrees C. Supersaturated fluids exhibit a stable, near-maximum liquid density with little variation along a very broad pressure range near room temperature, as discussed under FIG. 2 herein. Supercritical fluids when compressed to higher fluid pressures than 2000 psi can exhibit very high liquid-like densities with no surface tension and very low viscosities, and are used in the present invention for injection into very long EJTMC capillary condenser assemblies as discussed under FIG. 4A herein.

Figure 6:
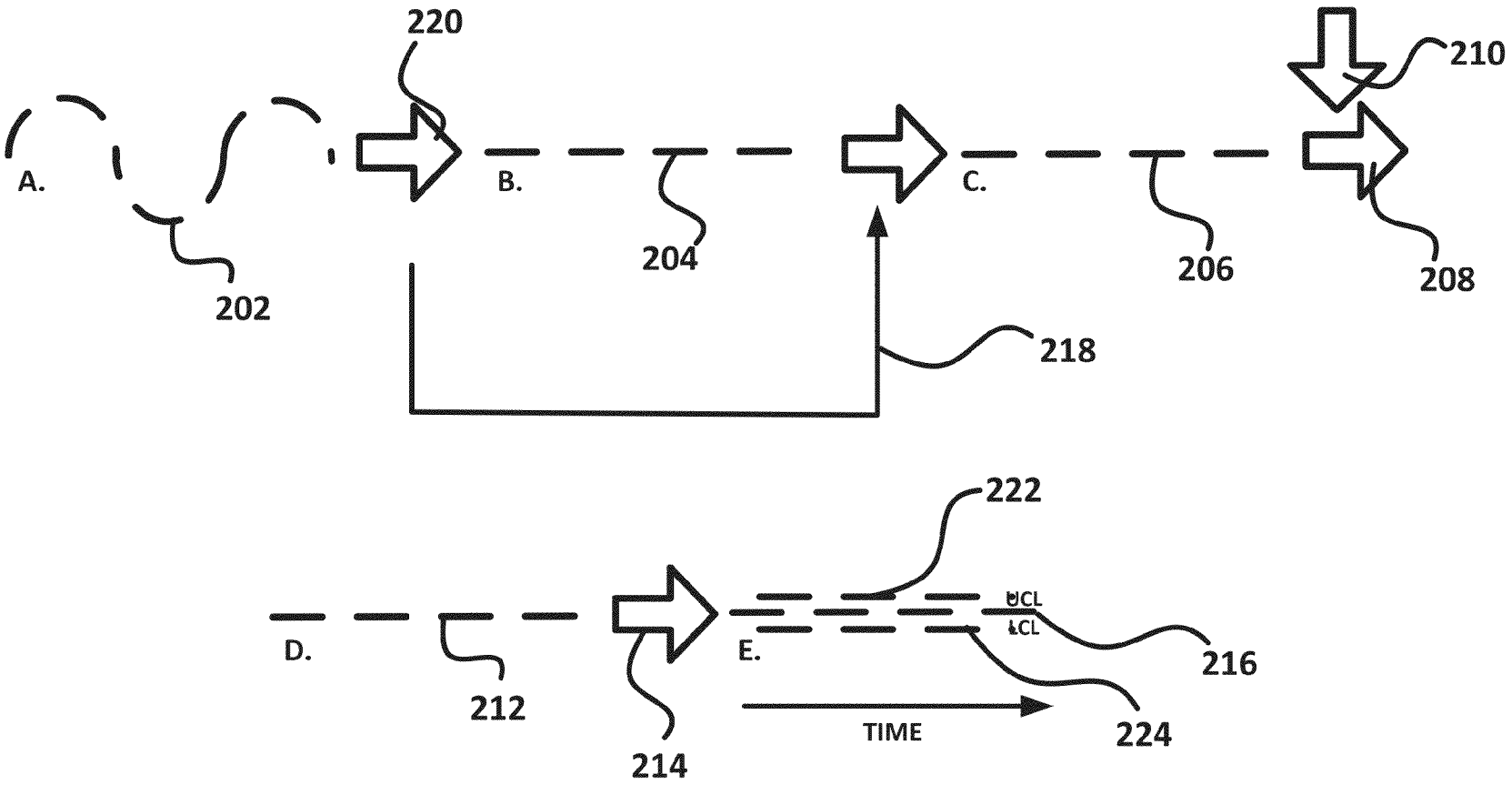
FIG. 6 illustrates schematically the present invention using the high-pressure enhanced Joule-Thomson micro-capillary condensation technique using supersaturated liquid $CO_2$ mass flow control and high pressure micro-capillary condensation as a proactive control scheme for providing improved ultra-low mass flow and particle density control.

FIG. 6 illustrates schematically the present invention using the high-pressure enhanced Joule-Thomson micro-capillary condensation technique using supersaturated liquid $CO_2$ mass flow control and high pressure micro-capillary condensation as a proactive control scheme for providing improved ultra-low mass flow and particle density control. Referring to FIG. 6, the present invention provide a stable source of supersaturated liquid $CO_2$ (or supercritical $CO_2$) for capillary condensation processes to produce a consistent and stable supply of $CO_2$ particles for injection and mixing with a propellant gas, having a constant pressure and temperature. The reasons for this stability, and as discussed herein, are related to a number of contributing factors including; elimination of prior art constraints related to changes in bulk $CO_2$ gas supply tank pressures and temperatures during withdraw and usage, changes in environmental temperatures such as factory temperatures and outside storage tank and delivery system temperatures, temperature variations within the $CO_2$ gas supply lines from source to ceiling or floor to cleaning system, variations in high pressure gas delivery system supply pressures and temperatures, and variations in internal pressure and temperature of refrigerant condenser systems used to condense transported high pressure gas to a cold saturated liquid $CO_2$ supply.

This results in a highly stable and predictable supply of liquid $CO_2$ feedstock (202) which results in constant density (204), constant capillary boiling densities and resulting stability and control of particle size and density (206), and upon injection (208) and mixing with a heated propellant gas (210), produce a stable $CO_2$ Composite Spray composition (212) of $CO_2$ particles and propellant gas which when projected (214) at a surface produce a stable cleaning (or cooling) rate (216).

The present invention control means involves a proactive scheme (218), whereby the $CO_2$ supply is controlled as discussed herein—and the capillary injection pressure (220) is adjusted manually or automatically as needed to produce a different $CO_2$ Composite Spray particle injection rates and compositions (212). As a result the present invention maintains a much tighter range between an acceptable upper control composition limit (222) and lower control composition limit (224) over time. The prior art constraints are eliminated for extremely low liquid $CO_2$ injection rates and capillary flows (small capillary diameters).

Figure 7:
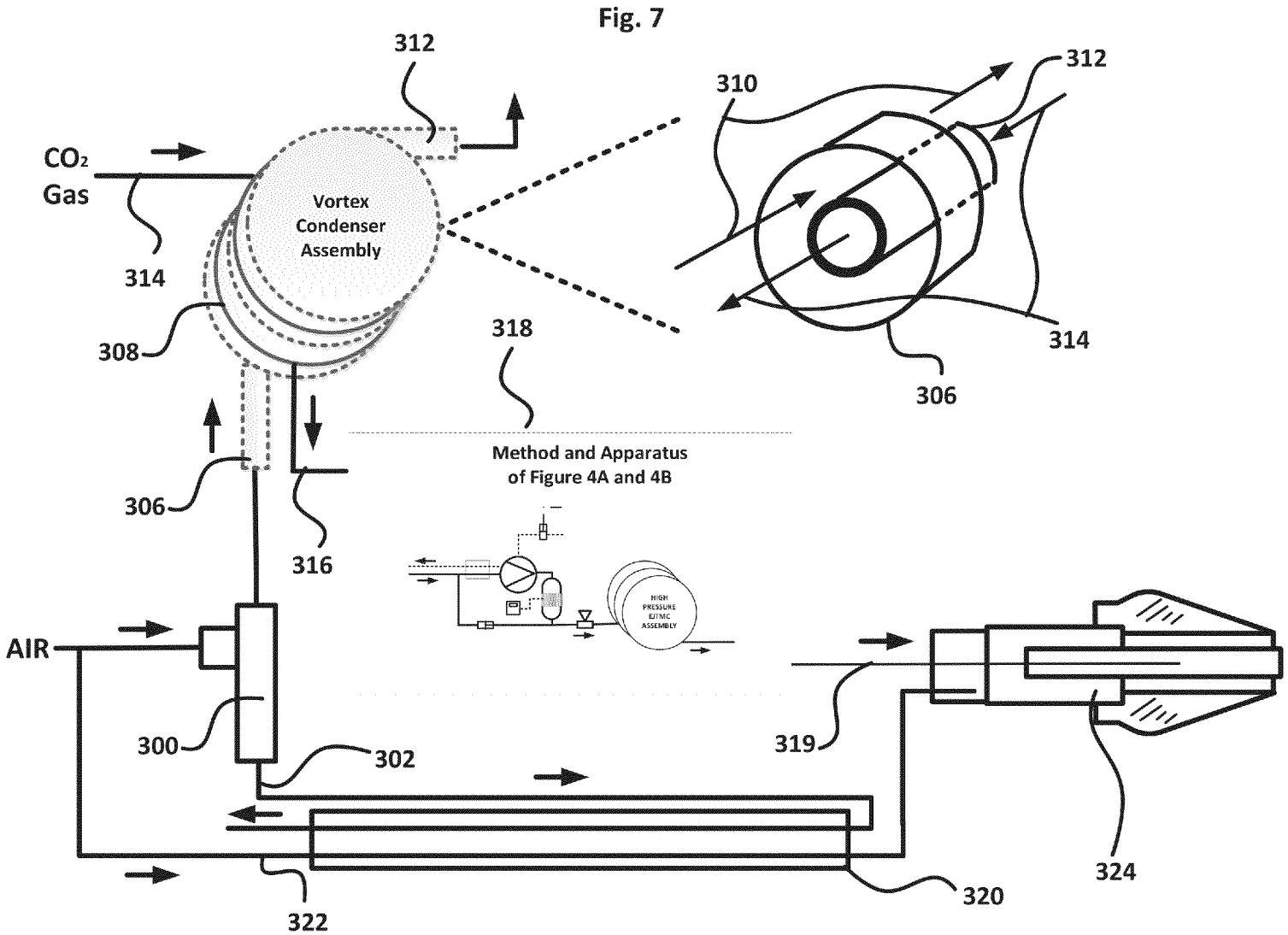
FIG. 7 schematically illustrates an embodiment of the present invention comprising an exemplary Vortex-based condensing system to produce a supply of saturated liquid $CO_2$ feedstock for use in the present invention.
Figure 8:
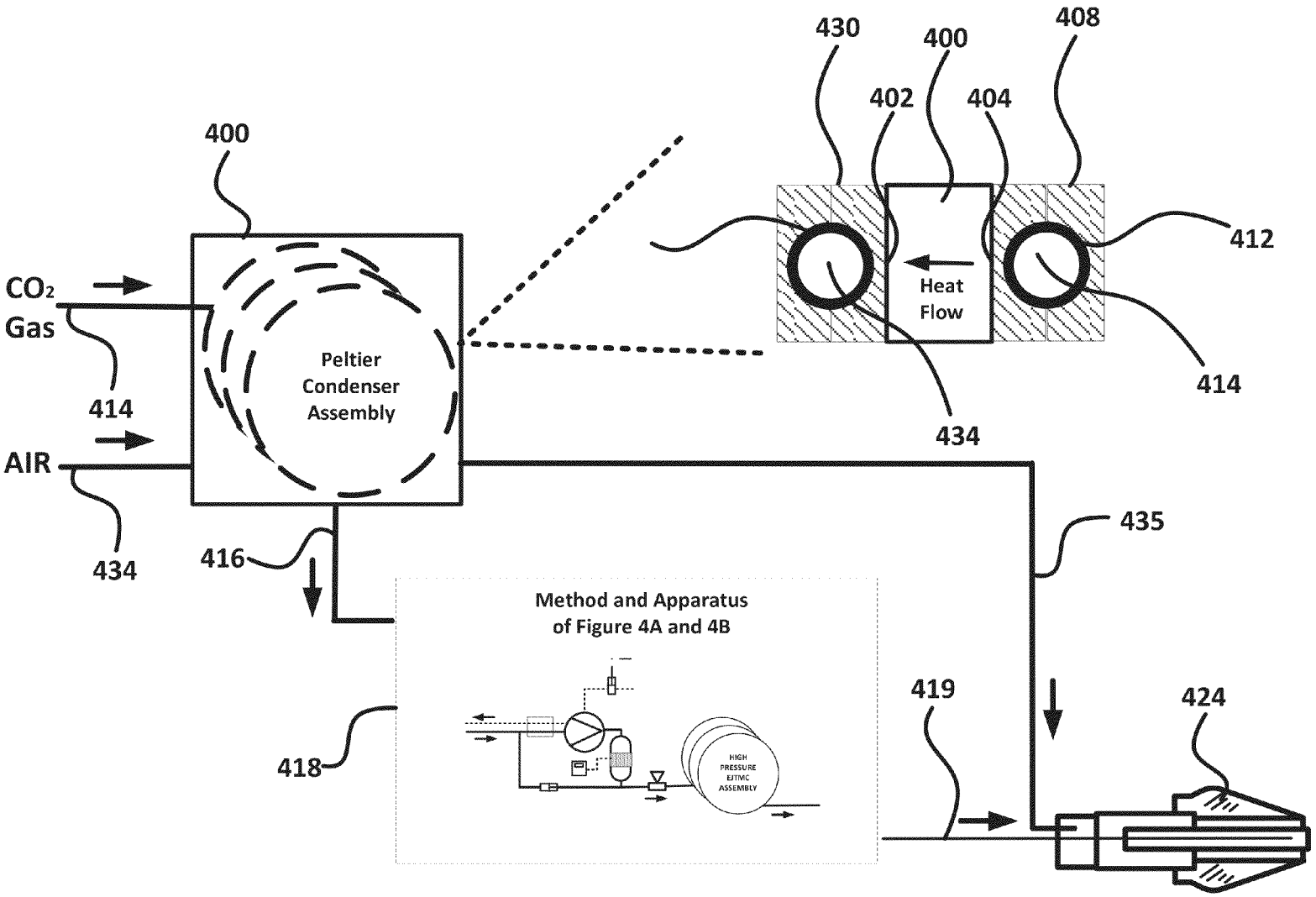
FIG. 8 schematically illustrates an embodiment of the present invention comprising an exemplary Peltier-based condensing system to produce a supply of saturated liquid $CO_2$ feedstock for use in the present invention.

Having thus described the present invention and its advantages over the prior art, the following detailed discussion illustrates two novel methods and apparatuses under FIGS. 7 and 8, respectively, for creating a low-volume supply of saturated liquid $CO_2$ for use with the present invention.

FIG. 7 schematically illustrates an embodiment of the present invention comprising an exemplary Vortex-based condensing system to produce a supply of saturated liquid $CO_2$ feedstock for use in the present invention. Referring to FIG. 7, a vortex device (300) is used to create a hot air stream (302) and a cold air stream (304). The cold air stream (304) is fluidly connected to the inlet of an outer insulating tube (306), for example a polyurethane tube, of a tube-in-tube heat exchanger (308) and flows in a countercurrent direction (310) over an inner thermally conductive tube (312), for example a copper tube, which is fluidly connected to source of $CO_2$ gas (314) flowing through the inner thermally conductive tube (312) at a pressure of between 750 psi and 850 psi. The $CO_2$ gas flowing through the inner tube (312) condenses (at saturation pressure) into a feedstock of saturated liquid $CO_2$ (316), along the saturation line of FIG. 5 (156) which is fluidly connected to the apparatus of FIG. 4A (318); which produces a stable supply of $CO_2$ particles for injection (319) into a coaxial propellant mixing tube and spray nozzle (324).

As a novel means for improving the efficiency of a Vortex-based condensing technique, the present invention uses a tube-in-tube heat exchanger and flow scheme as described above for the hot fluid (302) produced by the Vortex device (300). The hot air flows countercurrent through a thermally insulative conduit (320) containing an inner thermally conductive conduit (322) flowing a propellant gas. The propellant gas flowing through the conductive conduit (322) is heated and which is supplied to the exemplary coaxial mixing tube and nozzle (324).

The Vortex device as used in the present invention provides both a $CO_2$ condensing and propellant heating functions, which conserves energy and improves overall system efficiency for small-volume supply systems for use with the present invention. Vortex devices are available from a number of sources and in a range of cooling (and heating) capacities.

FIG. 8 schematically illustrates an embodiment of the present invention comprising an exemplary Peltier-based condensing system to produce a supply of saturated liquid $CO_2$ feedstock for use in the present invention. Referring to FIG. 8, a Peltier device (400) is used to create a hot side (402) and a cold side (404). The cold side (404) is mated with a tube-in-shell heat exchanger (408) which contains an inner thermally conductive tube (412), for example a copper tube, which is fluidly connected to source of $CO_2$ gas (414) flowing through the inner thermally conductive tube (412) at a pressure of between 750 psi and 850 psi. The $CO_2$ gas (414) flowing through the inner tube (412) condenses (at saturation pressure) into a feedstock of saturated liquid $CO_2$ (416), along the saturation line of FIG. 5 (156) which is fluidly connected to the apparatus of FIG. 4A (418); which produces a stable supply of $CO_2$ particles for injection (419) into a coaxial propellant mixing tube and spray nozzle (424).

As a novel means for improving the efficiency of a Peltier-based condensing technique, the present invention uses a tube-in-shell heat exchanger and flow scheme as described above for the hot side (402) produced by the Peltier device (400). The hot side is mated to a tube-in-shell heat exchanger (430) which contains an inner thermally conductive tube (432), for example a copper tube, which is fluidly connected to source of propellant gas (434). The propellant gas (434) flowing through the conductive tube (432) is heated, producing a heated propellant gas (435), which is supplied to the exemplary coaxial mixing tube and nozzle (424).

The Peltier device as used in the present invention provides both a $CO_2$ condensing and propellant heating functions, which conserves energy and improves overall system efficiency for small-volume supply systems for use with the present invention. Peltier devices are available from a number of sources and in a range of cooling (and heating) capacities.

EXPERIMENTAL 1

Having thus described the preferred and exemplary embodiments of the present invention, the following discussion by reference to FIGS. 9A, 9B, 9C, 9D, 9E and 9F details experimental testing, results, and analysis comparing and contrasting the performance characteristics between the present invention with the prior art—specifically prior-art and first-generation spray cleaning system described and operated under U.S. Pat. No. 5,725,154 (U.S. Pat. No. '154) and prior-art and second-generation spray cleaning system described and operated under U.S. Pat. No. 7,451,941 (U.S. Pat. No. '941) spray system scheme modified with a stepped capillary system described under U.S. Pat. No. 7,293,570 (U.S. Pat. No. '570). All $CO_2$ composite spray cleaning systems tested under operated under equivalent dense fluid propellant gas pressure and temperature conditions.

Test Apparatus and Conditions for the Present Invention:

A commercial $CO_2$ composite spray system called the PowerSno™ $CO_2$ composite spray cleaning system, Model PS6000, manufactured by CleanLogix LLC, Santa Clarita, Calif., described under U.S. Pat. No. 7,451,941 (U.S. Pat. No. '941) was modified using the present invention. The system modifications comprised the apparatus of FIG. 4A (high pressure capillary condenser assembly) and FIG. 4B (spray nozzle). The modified spray system was set-up and operated using key process test parameters as described under Table 1. The $CO_2$ "microseeds" produced by an 0.008 inch ID EJTMC assembly of FIG. 4A (106), 12 inches in length, were fed into the adjustable spray nozzle of FIG. 4B and expanded into a coarse particle feed stream using an exemplary expansion chamber—6 inch long×0.0625 inch ID expansion chamber of FIG. 4B (514)—prior to injection into (and mixing with) the propellant gas stream of FIG. 4B (525).

TABLE 1

Experimental Test Parameters for Present Invention

| Key Test Parameters | Values |
|---|---|
| Dense Fluid Propellant Gas | Clean Dry Air (−40 Degree F. Dew Point) |
| Dense Fluid Propellant Gas Temperature | 200 degrees C. |

TABLE 1-continued

Experimental Test Parameters for Present Invention

| Key Test Parameters | Values |
|---|---|
| Dense Fluid Propellant Gas Flow Rate (Pressure) | 1.7 scfm (at 100 psi) |
| EJTMC Segment Length | 12 inches |
| EJTMC Segment Internal Diameter | 0.008 inches (expanded into coarse particles) |
| EJTMC Feed Pressure and Temperature | 1200 psi/15 degrees C. (Super-saturated Liq. $CO_2$) |
| $CO_2$ Mass Flow through EJTMC Assembly | 1.25 lbs/hour |
| $CO_2$ Particle Type (Fine/Coarse) | Coarse (Expanded High Pressure Micro-Spray) |

Test Apparatus and Conditions for Prior Art:

The apparatus used to demonstrate the spray performance of a first-generation spray system (U.S. Pat. No. 5,725,154 (U.S. Pat. No. '154)) comprised a MicroSno™ $CO_2$ spray cleaning system, Model MS6000, manufactured by Deflex Corporation, Santa Clarita, Calif., using a single segment of 36 inch long 0.030 inch internal diameter (0.0625 inch outside diameter) PEEK coaxial $CO_2$ condenser capillary. As shown under Table 2, the key test parameters used for dense fluid propellant gas type, temperature, and pressure were equivalent to the test conditions used with present invention and used the capillary condensation and nozzle mixing scheme of U.S. Pat. No. '154.

TABLE 2

Experimental Test Parameters for U.S. Patent '154

| Key Test Parameters | Values |
|---|---|
| Dense Fluid Propellant Gas | Clean Dry Air (−40 Degree F. Dew Point) |
| Dense Fluid Propellant Gas Temperature | 200 degrees C. |
| Dense Fluid Propellant Gas Flow Rate (Pressure) | 3.2 scfm (at 100 psi) |
| Capillary Segment Length | 36 inches |
| Capillary Segment Internal Diameter | 0.030 inches |
| Capillary Feed Pressure and Temperature | 800 psi/15 degrees C. (Saturated Liquid $CO_2$) |
| $CO_2$ Mass Flow through Capillary Assembly | 10 lbs/hour (Lean Spray) |
| $CO_2$ Particle Type (Fine/Coarse) | Fine |

The apparatus used to demonstrate the spray performance of a second-generation spray system—U.S. Pat. No. 7,451,941 (U.S. Pat. No. '941) spray system scheme modified with U.S. Pat. No. 7,293,570 (U.S. Pat. No. '570)—comprised a PowerSno™ $CO_2$ composite spray cleaning system, Model PS6000, manufactured by CleanLogix LLC, Santa Clarita, Calif., using a "stepped" Enhanced Joule-Thomson Capillary (EJTC) condenser system comprising a 30 inch segment of 0.030 inch internal diameter (0.0625 inch outside diameter) PEEK tubing connected to a 30 inch segment of 0.070 inch internal diameter (0.125 inch outside diameter) PEEK capillary tube. As shown under Table 3, the key test parameters used for dense fluid propellant gas type, temperature, and pressure were equivalent to the test conditions used with present invention and used the capillary condensation and nozzle mixing schemes of U.S. Pat. No. '941 (EJTC condenser-nozzle-spray scheme) and U.S. Pat. No. '570 (stepped capillary scheme), respectively.

TABLE 3

Experimental Test Parameters for U.S. Patents '570/'941

| Key Test Parameters | Values |
|---|---|
| Dense Fluid Propellant Gas | Clean Dry Air (−40 Degree F. Dew Point) |
| Dense Fluid Propellant Gas Temperature | 200 degrees C. |
| Dense Fluid Propellant Gas Flow Rate (Pressure) | 3.2 scfm (at 100 psi) |
| EJTC Segment Length | 60 inches |
| EJTC Segment Internal Diameters (Stepped) | 0.030 inch to 0.070 inch |
| EJTC Feed Pressure and Temperature | 800 psi/15 degrees C. (Saturated Liquid $CO_2$) |
| $CO_2$ Mass Flow through EJTC Assembly | 10 lbs/hour (Lean Spray) |
| $CO_2$ Particle Type (Fine/Coarse) | Coarse (Stepped Expansion) |

Figure 9A:
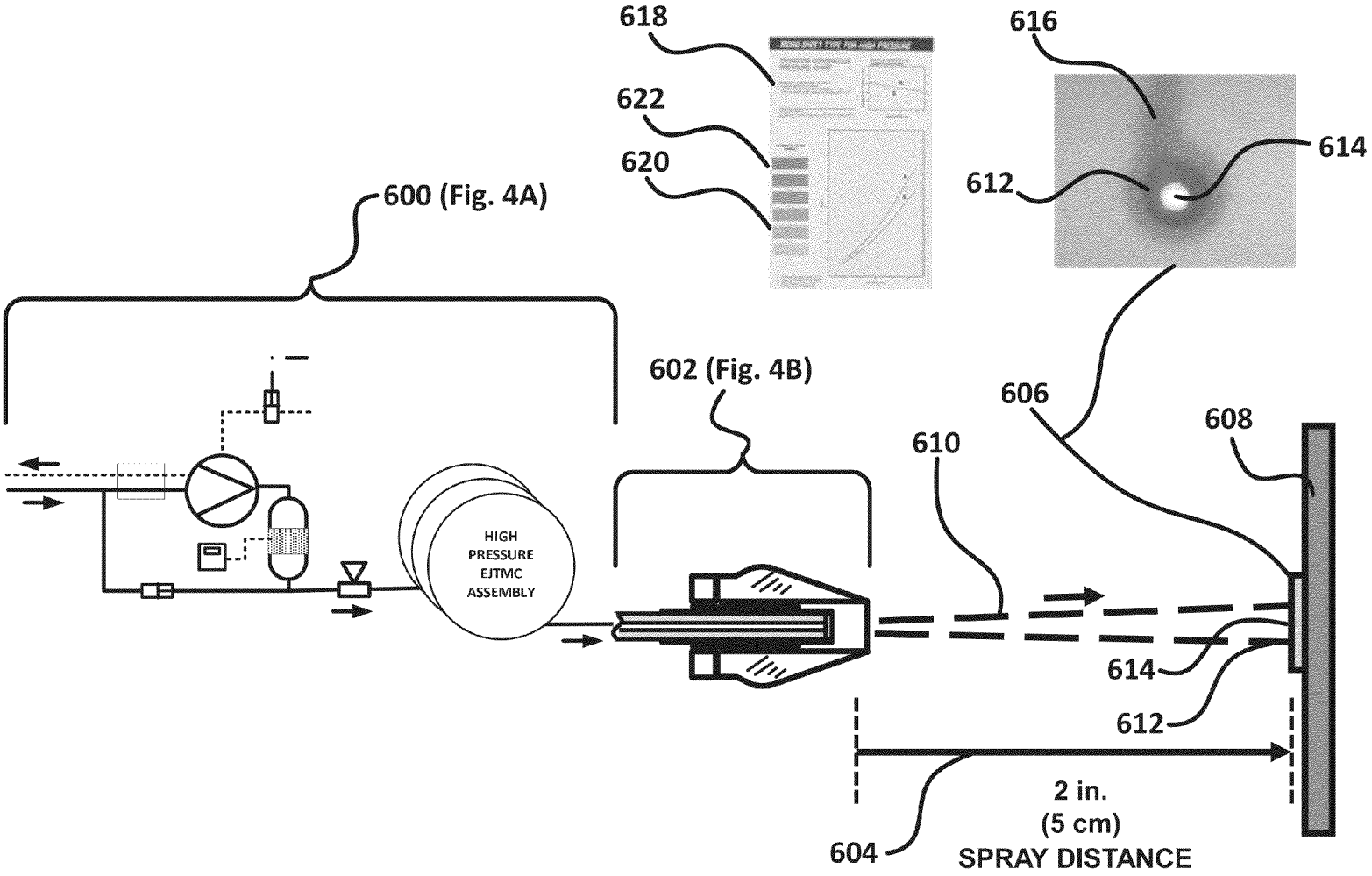
FIG. 9A schematically illustrates the experimental apparatus and method for demonstrating the adjustable range of spray energy using the present invention.

Spray Power Test Apparatus and Method:

The present invention and prior art systems—U.S. Pat. No. '154 (first-generation spray) and U.S. Pat. Nos. '570/'941 (second-generation spray)—were tested to determine the maximum achievable spray impact stress, under identical propellant gas pressures and temperatures. Referring to FIG. 9A, the present invention including a prior-art PowerSno™ Model PS600 $CO_2$ spray system modified with the apparatus of FIG. 4A (600) and FIG. 4B (602) (spray nozzle) was positioned with the spray nozzle 2 inches (604) from a 2" rectangular piece of FujiFilm™ Mylar micro-encapsulated contact pressure test film (606)—a available from Tekscan, Boston, Mass.—taped to a sheet metal supporting base plate (608). Various types of FujiFilm impact stress films are available from Tekscan with pressure ranges from 0.1 MPa to 130 MPa. Again referring to FIG. 9A, the initial test used the PowerSno modifications of FIG. 4A (600) and FIG. 4B (602) to produce a $CO_2$ composite spray (610), and using the spray test parameters listed under Table 1 (coarse particle stream), which was directed at the test film (606) at an impact angle of approximately 90° for approximately 60 seconds to achieve complete film color development. Spray impact stresses are indicated on the pressure-sensitive film, as color variations on the impacted film ranging from colorless, to faint pink, and to dark red (highest impact stress). It is noteworthy that the spray impact testing using the present invention almost immediately physically damaged a FujiFilm HS high-pressure film (50-100 MPa range) surface—producing a dark red color at the perimeter of the spray (612), indicating a shear stress of approximately 80 MPa, and completely etching away the Mylar film entirely at the center of the spray (614), indicating a shear stress of greater than 100 MPa. This damage required moving the spray head across the test film very rapidly to complete the 60 second exposure cycle, producing lighter reddish color development pattern (616). FujiFilm pressure test films, ranging from low pressure ranges to high pressures ranges, are supplied film color-to-pressure correlation charts. Using the FujiFilm HS high pressure film chart (618), the spray testing for the present invention indicates a maximum impact pressure of between 80 MPa (620) at the spray perimeter to as high as 100 MPa at center of the spray, and even higher based on the physical damage to the film (622). As such, the reliable film pressure measurements accepted under this experiment for comparison and discussion of results are considered very conservative, and more than likely exceed the maximum shear stress value reported herein significantly.

Subsequently, the identical spray impact test procedure was performed using the prior art $CO_2$ spray systems—'U.S. Pat. No. '154 and U.S. Pat. Nos. '570/'941—and using the spray test conditions listed under Table 2 and Table 3, respectively. These spray tests necessitated the use of lower pressure films—FujiFilm LS (10-50 MPa range) for '570/'941 and LW (2.5-10 MPa range) for '154—due to the lower impact stresses produced by both prior art systems. It is noteworthy that neither of the prior art systems physically damaged the pressure-sensitive Mylar film surfaces during spray impact tests.

Figure 9B:
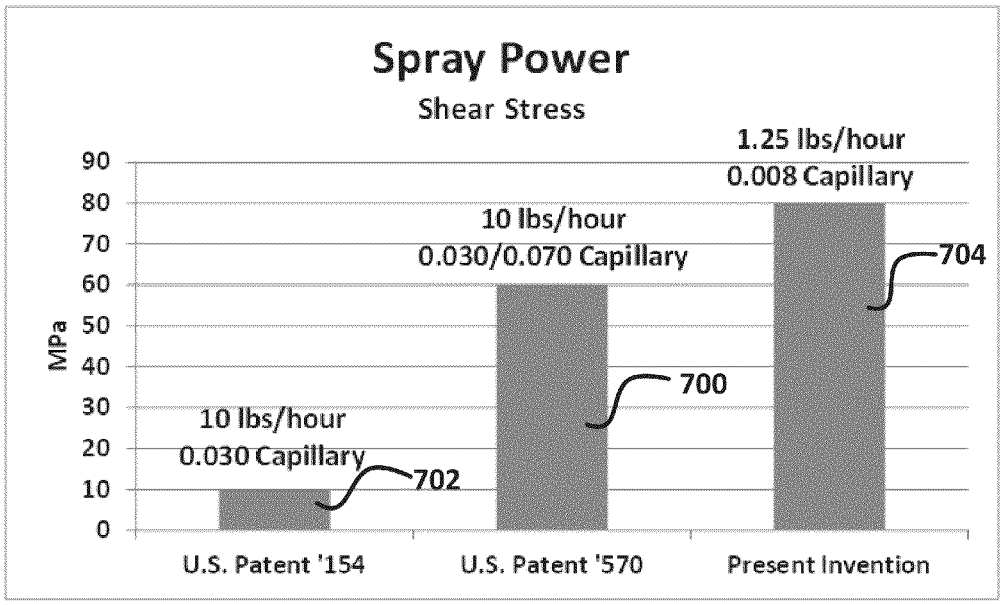
FIG. 9B provides experimental evidence demonstrating the spray power of the present invention.
Figure 9C:
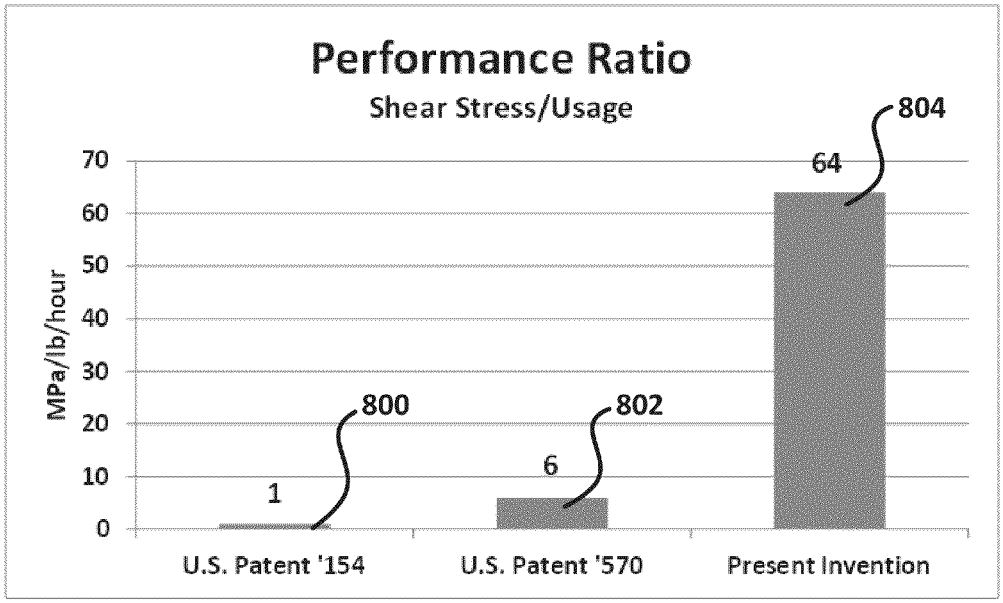
FIG. 9C provides experimental evidence demonstrating the spray performance of the present invention.

Results:

The spray impact tests revealed both expected and unexpected results. Referring to FIG. 9B, as expected the coarse particle-laden spray stream produced by the prior art second-generation U.S. Pat. Nos. '570/'941 $CO_2$ spray system using a stepped capillary scheme yielded impact shear stresses of about 500% greater than the single capillary system used in the first-generation U.S. Pat. No. '154 $CO_2$ spray system test. U.S. Pat. Nos. '570/'941 system (0.030/0/070 stepped capillary) yielded a peak shear stress of about 60 MPa (700) and the U.S. Pat. No. '154 system (0.030 capillary) achieved a peak shear stress of about 10 MPa (702), using the key spray process conditions listed under Table 3 and Table 2, respectively.

The coarse particle-laden spray stream produced by the present invention using the high-pressure micro-capillary condensation process and expansion processes of FIG. 4A and FIG. 4B, respectively, yielded a peak impact shear stress of (at least) 80 MPa (704)—700% greater than the single capillary system used in the U.S. Pat. No. '154 spray test and more than 33% greater than the stepped capillary enhancement used in the U.S. Pat. Nos. '570/'941 process. Most notably the present invention uses much smaller particles (practically invisible to the unaided eye) and approximately 88% less $CO_2$ usage, indicative of a much more energetic spray process with superior $CO_2$ economy. Spray testing experiments were also performed to determine the range for the present invention. This was accomplished by adjusting the expansion volume (V1) of the exemplary spray nozzle of FIG. 4B to provide a minimum expansion volume and a maximum volume therein. Energetic microscopic particle streams produced by the present invention produced shear stresses less than 2 MPa (at 100 psi propellant pressure) to at least 80 MPa.

Discussion of Results:

The directed performance goals for the present invention were to produce adequate cleaning power while using only very small quantities of $CO_2$. As such, the actual spray impact results for the present invention under FIG. 9B (704) were quite unexpected and appear counterintuitive. The spray test experiments were repeated several times to confirm the results reported herein. Referring again to FIG. 9B, the expected result was that smaller and fewer particles (i.e., microseeds) produced by the present invention would produce spray impacts which would be less than U.S. Pat. Nos. '570/'941 (700), or possibly even less than U.S. Pat. No. '154 (702). This initial logic and expectation seemed appropriate given the spray power dependency established between the two prior art systems, which is based on particle size (assuming all of key spray parameters are maintained somewhat the same).

Quite remarkably the present invention produces a range of spray impact stresses—from less than U.S. Pat. No. '154 (as expected) for ultrafine particles being produced to greater than U.S. Pat. Nos. '570/'941 for coarser particles (not expected)—and demonstrated this adjustable spray power range using 80%+less $CO_2$ than the prior art spray systems.

The significant performance of the present invention is demonstrated aptly by comparing the spray performance ratios between the three spray systems tested. A performance ratio (PR) is calculated as maximum shear stress (MPa)

divided by $CO_2$ usage (lbs/hour). Now referring to FIG. 9C, the first-generation $CO_2$ composite spray system, U.S. Pat. No. '154, using a 0.030 inch capillary condenser is considered a benchmark, and has a performance ratio value of 10 MPa divided by 10 lbs/hour or a PR=1 (800). The performance ratio of the U.S. Pat. Nos. '570/'941 spray system using a stepped 0.030/0.070 inch capillary condenser gives a maximum performance ratio of PR=6 (802) or 5× greater than U.S. Pat. No. '154. The present invention produces a PR=64 (804), which is 64× greater than U.S. Pat. No. '154 spray system and 11× greater than the U.S. Pat. Nos. '570/'941 spray system.

Possible explanations for the enhanced performance of the present invention are offered as follows by contrast to prior art $CO_2$ sprays. High-pressure capillary injection of microseeds into the small expansion chamber of FIG. 4B (514) produces smaller and harder $CO_2$ particles which have a higher density, and which move at much higher velocity which produces more energetic surface impacts. Evidence for this supposition is a rather loud jet crackling sound present during particle expansion (i.e., maximum V1), which is not present in the prior art tested herein. Jet noise crackle arises in supersonic jet flows (Reference: Quantifying crackle-inducing acoustic shock-structures emitted by a fully-expanded Mach 3 jet, Baars et al, AIAA Journal, May 27-29, 2013).

Another factor is surface impact density. More numerous and smaller particles increase contact area at the substrate surface interface. High frequency energetic impacts produce higher outflow velocities for the resulting splat and the production of higher unload stresses.

Figure 9D:
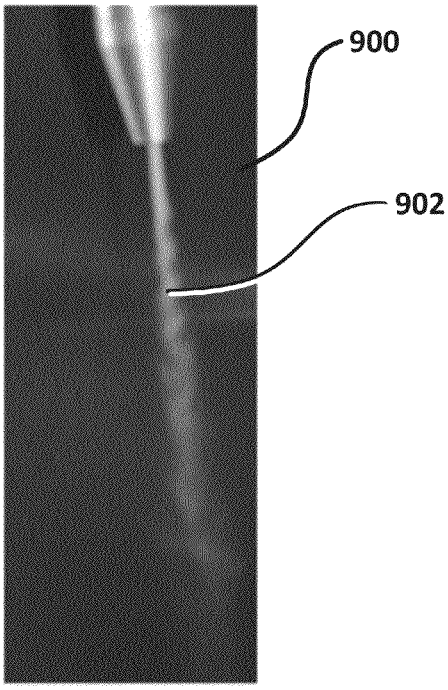
Fig. 9D PRIOR ART
FIG. 9D is a picture of the prior art $CO_2$ Composite Spray in normal light.

Related to this, and possibly one of the most critical factors is $CO_2$ composite spray geometry. $CO_2$ composite spray abnormalities present in the prior art, and already discussed herein, include spray pulsing and spray particle density fluctuations. These defects are primarily caused by changing pressure and temperature conditions in the saturated liquid $CO_2$ during injection into the capillary condenser assembly. Another spray abnormality present in the prior art is spray swirling or rotation. Spray rotation occurs following mixing of the $CO_2$ particles from the capillary condenser (regardless of type) into the propellant gas. The variations between particle-propellant gas velocities, densities and temperatures result in vortexing, thermal flux and drag—all of which results in what is observed as a rotating spray stream—so-called Kelvin-Helmholtz instability. These abnormalities result in reduced spray cleaning or cooling energy available to the surface being treated. Referring to FIG. 9D, the prior art spray (900) produces a pulsating and swirling particle-gas stream (902) that is visible to the un-aided eye in normal room light.

Figure 9E:
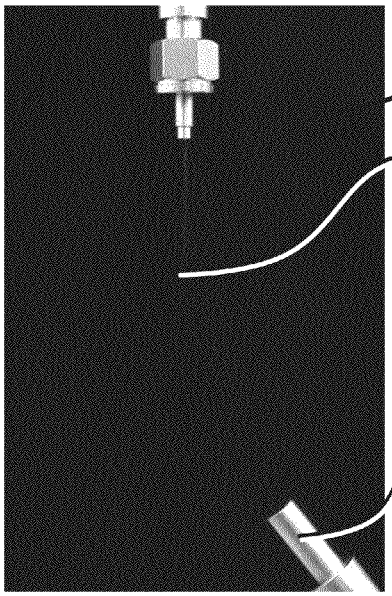
FIG. 9E is a picture of the $CO_2$ Composite Spray of the present invention in normal light.
Figure 9F:
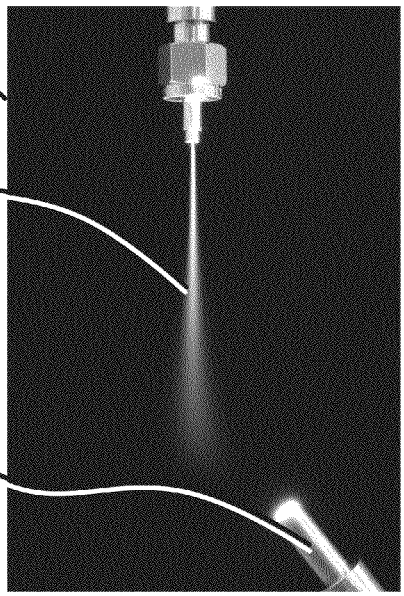
FIG. 9F is a picture of the $CO_2$ Composite Spray of the present invention under illumination.

The present invention resolves the prior art spray defects using high-pressure micro-capillary condensation coupled with pressure-balancing within an adjustable nozzle assembly. Referring to FIG. 9E, the present invention produces a steady-state non-swirling jet stream (904) which is barely perceptible to an un-aided eye in normal room light (906) and without illumination (908). Moreover, and referring to FIG. 9F, the $CO_2$ composite spray (910) produced by the present invention is actually quite dense—populated with innumerable hard, fast-moving microscopic $CO_2$ particles when illuminated with a bright white light (912). Moreover, the present invention demonstrates and confirms fluid stream balancing, evidenced by a lack of swirling within the spray stream. It is believed the supercritical fluid pressure conditions used in the present invention produce a micronizing effect, similar to the RESS (Rapid Expansion of Supercritical Solutions) process, wherein the highly compressed $CO_2$ fluid is rapidly expanded to produce more numerous microscopic crystals of solid carbon dioxide which have very high surface area, higher density and higher trajectory velocities (i.e., less drag) as compared to the prior art. As such, the experimental results demonstrated in the present invention are indicative of high frequency, high energy, and closely-packed surface impacts with minimized propellant-particle mixing turbulence.

EXPERIMENTAL 2

An experiment was performed to determine the relationship between spray mixing temperature of a $CO_2$ Composite Spray with the variation in micro-capillary pressure of within the EJTMC assembly.

Spray Power Test Apparatus and Method:

The present invention was tested to determine the changes in composite spray mixing temperature for an exemplary high pressure micro-capillary while maintaining a fixed mixing propellant gas (clean dry air) pressure, flow rate and temperature. The test apparatus for the present experiment comprised a prior-art PowerSno™ Model PS6000 $CO_2$ spray system modified with the apparatus of FIG. 4A and FIG. 4B. The mixing spray nozzle of FIG. 4B was positioned 0.25 inches from a K-Type thermocouple connected to a digital thermometer —Omega Model CL23A, Omega Engineering. The EJTMC high-pressure condenser of FIG. 4A (106) comprised a 12 inch long micro-capillary having an internal diameter of 0.008 inches positioned coaxially (and adjustably) within the spray nozzle apparatus of FIG. 4B. The coaxial $CO_2$ spray assembly thus described was operated with a propellant gas flow fixed at a pressure of 70 psi at a fixed temperature of 20 Degrees C, and a propellant gas flow rate of about 2 scfm. Liquid $CO_2$ supply pressure to the micro-capillary EJTMC assembly was adjusted within the range stepwise from 0 psi (no injection) to 2000 psi. The mixed spray temperature was measured and recorded for each supersaturated injection pressure step.

Results:

Reproducible spray mixing temperatures for several micro-capillary pressure values are summarized under Table 4.

TABLE 4

Experimental Test Parameters for Present Invention

| Micro-Capillary Pressure (PSI) | Mixing Temperature (Deg. C.) |
|---|---|
| 0 | 20 |
| 900 | 5.4 |
| 1000 | 4.1 |
| 1100 | 3.9 |
| 1200 | 2.1 |
| 1500 | −0.3 |
| 2000 | −6 |

Discussion of Results:

Referring to FIG. 10, the spray temperature-versus-capillary pressure data within the range from 900 psi (1000) to 2000 psi (1002) provides a fairly linear curve (1004). The linear curve can be relied upon within the range tested. Using the test apparatus as configured provides an adjustable spray mix temperature—for example as used within a machining or cooling application—by changing the EJTMC supersaturation pressure in accordance with the curve equation (1006) shown in FIG. 10, as an example. Interestingly, the overall mixed spray pressure does not increase appreciably as the capillary pressure is increased, however the number of cooling particles visibly present in the mixed composite spray increases. This is indicative of enhanced Joule-Tompson cooling, and conversion of liquid to solid, due to an increase in the pressure drop (and temperature drop) within the micro-capillary assembly.

A spray apparatus for producing a stream of propellant gas and carbon dioxide comprising: the carbon dioxide in a first state, which is a saturated liquid; compressing the carbon dioxide in the first state to form a second state, which is super-saturated at a density greater than 0.9 g/ml; said compression is adjusted using a high pressure pump; a condensation of the carbon dioxide in the second state within a micro-capillary tube to form a third state, which is a microscopic solid; said propellant gas and said carbon dioxide in the third state are mixed to form the stream of the propellant gas and the carbon dioxide; said carbon dioxide mixing rate is adjusted using a high pressure pump; whereby the stream is used to treat a substrate surface.

The spray apparatus further having a micro-capillary, which is at least one high-pressure capillary tube for receiving supersaturated carbon dioxide; the micro-capillary has a length of from 6 inches to 20 feet, an outer diameter of from 0.020 inch to 0.125 inch, and an inner diameter of from 25 micron to about 0.010 inch; the micro-capillary comprises one or more capillaries in a parallel flow arrangement having a length of from 6 inches to 20 feet, an outer diameter of from 0.020 inch to 0.125 inch, and an inner diameter of from 25 micron to 0.010 inch; the micro-capillary comprises polyetheretherketone and stainless steel high pressure capillary tubes; the carbon dioxide in a first state is compressed to super-saturation using a high pressure pump; the high pressure pump can compresses the carbon dioxide in the first state into the micro-capillary to form the carbon dioxide in the second state, which is supersaturated; the supersaturated carbon dioxide is compressed within the micro-capillary to a pressure between 900 psi and 10,000 psi; the supersaturated carbon dioxide is compressed to a pressure between 1,000 psi and 5,000 psi; the supersaturated carbon dioxide is thermally controlled at a temperature between 5 degrees C. and 40 degrees C.; the supersaturated carbon dioxide is thermally controlled at a temperature between 15 degrees C. and 25 degrees C.

The propellant gas is clean dry air, nitrogen, argon or carbon dioxide; the propellant gas is thermally controlled at a temperature between 5 degrees C. and 250 degrees C.; the propellant gas and the carbon dioxide in the third state are mixed coaxially; the propellant gas and the carbon dioxide in the third state are mixed using an adjustable expansion tube for receiving the carbon dioxide in the third state produced by the pressurized micro-capillary; the saturated carbon dioxide is at a pressure of between 500 psi and 900 psi; the saturated carbon dioxide is at a temperature of between 5 degrees C. and 40 degrees C.; the supersaturated carbon dioxide is a liquid or a supercritical fluid.

A spray apparatus for producing a stream of propellant gas and carbon dioxide comprising: the carbon dioxide in a first state, which is liquid and saturated; a compression of the carbon dioxide in the first state to form a second state, which is super-saturated and at a higher pressure than the first state; a condensation of the carbon dioxide in the second state within a micro-capillary tube to form a third state, which is solid; and said propellant gas is mixed with said carbon dioxide in the third state to form the stream of propellant gas and carbon dioxide, whereby said stream is used to treat a substrate surface.

A method for producing a spray of propellant gas and carbon dioxide comprising:

a. Compressing the carbon dioxide in a first state which is saturated, to form a second state, which is super-saturated at a density greater than 0.9 g/ml;

b. Condensing the carbon dioxide in the second state within a micro-capillary tube to form a third state, which is a microscopic solid; and c. Mixing said propellant gas and said carbon dioxide in the third state to form the spray, Whereby said spray is used to treat a substrate surface.

The method can also have the propellant gas temperature between 5 degrees C. to 200 degrees C.; the propellant gas pressure is between 30 psi and 250 psi; the propellant gas is clean dry air, nitrogen, argon, or carbon dioxide; a high pressure pump is used to compress the saturated carbon dioxide within the micro-capillary at a pressure between 1,000 psi and 10,000 psi to form the supersaturated carbon dioxide; the supersaturated carbon dioxide temperature is adjusted between 5 degrees C. and 40 degrees C.; the propellant gas and the carbon dioxide in the third state are mixed and projected at the substrate surface using an adjustable expansion tube and mixing nozzle; the spray generates a shear stress on the substrate surface at between 10 kPa and 100 MPa; the spray produces a temperature on the substrate surface at between −40 degrees C. and 200 degrees C.; the supersaturated carbon dioxide is injected into the micro-capillary using a high pressure pump to produce carbon dioxide in the third state; an injection flow rate of the carbon dioxide in the third state is between 0.1 lbs per hour and 20 lbs per hour.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

The terms "a" or "an", as used herein, are defined as: one or more than one. The term plurality, as used herein, is defined as: two or more than two. The term another, as used herein, is defined as at least a second or more. The terms including and/or having, as used herein, are defined as comprising (i.e., open language). The term coupled, as used herein, is defined as connected, although not necessarily directly, and not necessarily mechanically.

Any element in a claim that does not explicitly state "means for" performing a specific function, or "step for" performing a specific function, is not be interpreted as a "means" or "step" clause as specified in 35 U.S.C. Sec. 112, Paragraph 6. In particular, the use of "step of" in the claims herein is not intended to invoke the provisions of 35 U.S.C. Sec. 112, Paragraph 6. All cited and referenced patents, patent applications and literature are all incorporated by reference in entirety.

What is claimed is:

1. A spray apparatus for producing a stream of propellant gas and carbon dioxide comprising:

the carbon dioxide in a first state, which is a saturated liquid;

compressing the carbon dioxide in the first state to form a second state, which is super-saturated at a density greater than 0.9 g/ml;

said compression is adjusted using a high pressure pump;

a condensation of the carbon dioxide in the second state within a micro-capillary tube to form a third state, which is a microscopic solid;

said propellant gas and said carbon dioxide in the third state are mixed to form the stream of the propellant gas and the carbon dioxide;

said carbon dioxide mixing rate is adjusted using a high pressure pump;

whereby the stream is used to treat a substrate surface.

2. The apparatus of claim 1 wherein micro-capillary is at least one high-pressure capillary tube for receiving supersaturated carbon dioxide.

3. The apparatus of claim 2 wherein the micro-capillary has a length of from 6 inches to 20 feet, an outer diameter of from 0.020 inch to 0.125 inch, and an inner diameter of from 25 micron to about 0.010 inch.

4. The apparatus of claim 2 wherein the micro-capillary comprises one or more capillaries in a parallel flow arrangement having a length of from 6 inches to 20 feet, an outer diameter of from 0.020 inch to 0.125 inch, and an inner diameter of from 25 micron to 0.010 inch.

5. The apparatus of claim 2 wherein the micro-capillary comprises polyetheretherketone and stainless steel high pressure capillary tubes.

6. The apparatus of claim 1 wherein the carbon dioxide in a first state is compressed to super-saturation using a high pressure pump.

7. The apparatus of claim 6 wherein the high pressure pump compresses the carbon dioxide in the first state into the micro-capillary to form the carbon dioxide in the second state, which is supersaturated.

8. The apparatus of claim 7 wherein the supersaturated carbon dioxide is compressed within the micro-capillary to a pressure between 900 psi and 10,000 psi.

9. The apparatus of claim 8 wherein the supersaturated carbon dioxide is compressed to a pressure between 1,000 psi and 5,000 psi.

10. The apparatus of claim 7 wherein the supersaturated carbon dioxide is thermally controlled at a temperature between 5 degrees C. and 40 degrees C.

11. The apparatus of claim 10 wherein the supersaturated carbon dioxide is thermally controlled at a temperature between 15 degrees C. and 25 degrees C.

12. The apparatus of claim 1 wherein the propellant gas is clean dry air, nitrogen, argon or carbon dioxide.

13. The apparatus of claim 12 wherein the propellant gas is thermally controlled at a temperature between 5 degrees C. and 250 degrees C.

14. The apparatus of claim 1 wherein the propellant gas and the carbon dioxide in the third state are mixed coaxially.

15. The apparatus of claim 1 wherein the propellant gas and the carbon dioxide in the third state are mixed using an adjustable expansion tube for receiving the carbon dioxide in the third state produced by the pressurized micro-capillary.

16. The apparatus of claim 1 wherein the saturated carbon dioxide is at a pressure of between 500 psi and 900 psi.

17. The apparatus of claim 1 wherein the saturated carbon dioxide is at a temperature of between 5 degrees C. and 40 degrees C.

18. The apparatus of claim 1 wherein the supersaturated carbon dioxide is a liquid or a supercritical fluid.

19. A spray apparatus for producing a stream of propellant gas and carbon dioxide comprising:

the carbon dioxide in a first state, which is liquid and saturated;

a compression of the carbon dioxide in the first state to form a second state, which is super-saturated and at a higher pressure than the first state;

a condensation of the carbon dioxide in the second state within a micro-capillary tube to form a third state, which is solid; and said propellant gas is mixed with said carbon dioxide in the third state to form the stream of propellant gas and carbon dioxide, whereby said stream is used to treat a substrate surface.

20. A method for producing a spray of propellant gas and carbon dioxide comprising:

d. Compressing the carbon dioxide in a first state which is saturated, to form a second state, which is super-saturated at a density greater than 0.9 g/ml;

e. Condensing the carbon dioxide in the second state within a micro-capillary tube to form a third state, which is a microscopic solid; and f. Mixing said propellant gas and said carbon dioxide in the third state to form the spray, Whereby said spray is used to treat a substrate surface.

21. The method of claim 20 wherein the propellant gas temperature is between 5 degrees C. to 200 degrees C.

22. The method of claim 20 wherein the propellant gas pressure is between 30 psi and 250 psi.

23. The method of claim 22 wherein the propellant gas is clean dry air, nitrogen, argon, or carbon dioxide.

24. The method of claim 20 wherein a high pressure pump is used to compress the saturated carbon dioxide within the micro-capillary at a pressure between 1,000 psi and 10,000 psi to form the supersaturated carbon dioxide.

25. The method of claim 20 wherein the supersaturated carbon dioxide temperature is adjusted between 5 degrees C. and 40 degrees C.

26. The method of claim 20 wherein the propellant gas and the carbon dioxide in the third state are mixed and projected at the substrate surface using an adjustable expansion tube and mixing nozzle.

27. The method of claim 20 wherein the spray generates a shear stress on the substrate surface at between 10 kPa and 100 MPa.

28. The method of claim 20 wherein the spray produces a temperature on the substrate surface at between −40 degrees C. and 200 degrees C.

29. The method of claim 20 wherein the supersaturated carbon dioxide is injected into the micro-capillary using a high pressure pump to produce carbon dioxide in the third state.

30. The method of claim 29 wherein an injection flow rate of the carbon dioxide in the third state is between 0.1 lbs per hour and 20 lbs per hour.

* * * * *